US010059122B2

(12) United States Patent
Ohi et al.

(10) Patent No.: US 10,059,122 B2
(45) Date of Patent: Aug. 28, 2018

(54) CONVEYOR LINE SYSTEM AND SHIPPING CONTAINER

(71) Applicants: Katsuya Ohi, Shizuoka (JP); Toshiaki Asai, Shizuoka (JP); Tomomi Ishimi, Shizuoka (JP)

(72) Inventors: Katsuya Ohi, Shizuoka (JP); Toshiaki Asai, Shizuoka (JP); Tomomi Ishimi, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 29 days.

(21) Appl. No.: 15/125,242

(22) PCT Filed: Mar. 10, 2015

(86) PCT No.: PCT/JP2015/056942
§ 371 (c)(1),
(2) Date: Sep. 12, 2016

(87) PCT Pub. No.: WO2015/137310
PCT Pub. Date: Sep. 17, 2015

(65) Prior Publication Data

US 2018/0009234 A1 Jan. 11, 2018

(30) Foreign Application Priority Data

Mar. 13, 2014 (JP) ..... 2014-050449

(51) Int. Cl.
*B41J 2/475* (2006.01)
*B41J 2/47* (2006.01)
(Continued)

(52) U.S. Cl.
CPC ..... *B41J 2/4753* (2013.01); *B41J 11/007* (2013.01); *B41M 5/46* (2013.01); *B41J 2002/4756* (2013.01); *B41M 7/0009* (2013.01)

(58) Field of Classification Search
CPC ..... B41J 2/4753; B41J 11/007; B41J 2002/4756; B41M 5/46; B41M 7/0009
See application file for complete search history.

(56) References Cited

U.S. PATENT DOCUMENTS 7,439,993 B2 * 10/2008 Ishimi ..... B41J 2/471 347/179
8,471,885 B2 6/2013 Ishmi et al.
(Continued)

FOREIGN PATENT DOCUMENTS

EP 1834796 A2 9/2007
EP 2165840 A1 3/2010
(Continued)

OTHER PUBLICATIONS

International Search Report dated Jun. 2, 2015 for counterpart International Patent Application No. PCT/JP2015/056942 filed Mar. 10, 2015.
(Continued)

*Primary Examiner* — Huan Tran
(74) *Attorney, Agent, or Firm* — Cooper & Dunham LLP

(57) ABSTRACT

A conveyor line system including an image processing device configured to irradiate a recording part with laser light to perform at least one of image recording and image erasing, the conveyor line system being configured to manage at least one conveying container each including: the recording part in which the image recording is performed by irradiation with the laser light; and an image part in which a displayed image has been drawn, wherein a formula below is satisfied at a wavelength of the laser light with which the recording part is irradiated during the image recording: A+30>B where A denotes an absorbance of the recording part and B denotes an absorbance of the image part of the conveying container.

14 Claims, 11 Drawing Sheets

(51) Int. Cl.

| | |
|---|---|
| ***B41M 5/46*** | (2006.01) |
| ***B41J 11/00*** | (2006.01) |
| *B41M 7/00* | (2006.01) |

(56) References Cited

U.S. PATENT DOCUMENTS

| | | | | |
|---|---|---|---|---|
| 8,665,496 | B2 | 3/2014 | Hasegawa et al. | |
| 8,730,293 | B2 * | 5/2014 | Yamamoto | B41J 11/008 347/110 |
| 8,643,689 | B2 | 12/2014 | Ishimi et al. | |
| 2007/0285488 | A1 | 12/2007 | Ishimi et al. | |
| 2008/0192618 | A1 | 8/2008 | Nakata et al. | |
| 2009/0203521 | A1 | 8/2009 | Ishimi et al. | |
| 2010/0069238 | A1 | 3/2010 | Asai et al. | |
| 2012/0075402 | A1 | 3/2012 | Ishimi et al. | |
| 2012/0211673 | A1 | 8/2012 | Yamamoto | |
| 2012/0212564 | A1 * | 8/2012 | Yamamoto | B41J 2/4753 347/225 |
| 2013/0135425 | A1 | 5/2013 | Yamamoto | |
| 2013/0141512 | A1 | 6/2013 | Asai et al. | |
| 2014/0099574 | A1 | 4/2014 | Kawahara et al. | |
| 2014/0152756 | A1 | 6/2014 | Ishikake et al. | |
| 2014/0158771 | A1 | 6/2014 | Ohi et al. | |
| 2014/0285606 | A1 | 9/2014 | Ishimi et al. | |

FOREIGN PATENT DOCUMENTS

| | | | | |
|---|---|---|---|---|
| EP | 2599634 | A1 | 6/2013 | |
| JP | 10-138641 | | 5/1998 | |
| JP | 2003-320692 | | 11/2003 | |
| JP | 2008-194905 | | 8/2008 | |
| JP | 2009-214538 | | 9/2009 | |
| JP | 2010-280498 | | 12/2010 | |
| JP | 2011-025508 | | 2/2011 | |
| JP | 2013-111888 | | 6/2013 | |
| WO | WO 2015/137476 | * | 9/2015 | B41M 5/305 |

OTHER PUBLICATIONS

European Search Report dated Apr. 4, 2017 in connection with corresponding European patent application No. 15760893.6.

* cited by examiner

CONVEYOR LINE SYSTEM AND SHIPPING CONTAINER

TECHNICAL FIELD

The present invention relates to a conveyor line system and a conveying container.

BACKGROUND ART

Hitherto, there have been proposed various kinds of conveyor line systems configured to convey conveying containers, to which thermoreversible recording media are attached as recording parts, in a predetermined conveying direction and configured to irradiate the thermoreversible recording media with laser light to rewrite images (see, for example, Patent documents 1, 2, and 3).

The conveyor line systems include image erasing devices configured to irradiate thermoreversible recording media, in which images have been recorded, with laser light to erase the images; and image recording devices configured to irradiate the thermoreversible recording media, from which the images have been erased by the image erasing devices, with laser light to record new images. Note that, the image erasing device and the image recording device may be collectively referred to as an image processing device.

It is desirable to accurately irradiate only the thermoreversible recording media with the laser light when the images are recorded in the thermoreversible recording media or the formed images are erased by irradiating the thermoreversible recording media with the laser light. Displayed images such as company logos, alarm displays, instructions, and barcode images are drawn on the conveying containers to which the thermoreversible recording media are attached. The displayed images formed on the conveying containers can improve handling property, safety, etc. of the conveying containers.

In the conveyor line systems, however, not only the thermoreversible recording media but also the conveying containers surrounding the thermoreversible recording media or the displayed images drawn on the conveying container may be irradiated with the laser light.

When the displayed images are irradiated with the laser light, the displayed images may be scraped depending on materials of the displayed images because the materials of the displayed images absorb the laser light. As the materials of the displayed images melt or sublimate by repetitive irradiation of the displayed images in the conveying containers with the laser light, the surfaces of the displayed images are gradually scraped. This raises a problem with deterioration in visibility or machine readability of the displayed images.

Even in the case of using thermosensitive recording media for single use, the above problem would arise when the conveying containers are repeatedly used. Also, depending on the relationship between absorbance of the recording part and absorbance of the image part, in which the displayed image is drawn, at a wavelength of the laser light emitted by the image processing device during image recording, even when the image part is irradiated with the laser light only once, for example, confidential information is unintentionally recorded on the image part in which the displayed image is drawn. This may raise a problem with leakage of confidential information.

Two cases are considered as reasons why the displayed image is unintentionally irradiated with laser light.

The first case is that a thermoreversible recording medium has not been attached to a position to be irradiated with laser light for the following reason, for example: the thermoreversible recording medium attached to the conveying container has been peeled; a conveying container with no thermoreversible recording medium attached has been included by accident; or a worker for putting the conveying container has mistaken a direction of the conveying container.

The second case is that a position of the thermoreversible recording medium and a position to be irradiated with laser light have been mismatched for the following reason, for example: there has been an error in positioning information for changing the laser light irradiation position per conveying container in the case where conveying containers included are different in at least one of a size and a shape and as a result the relative positions of the thermoreversible recording media attached to such conveying containers with respect to the image processing device are also different during at least one of image recording and image erasing; a position of the conveying container placed on the conveyor line has been misregistered; the thermoreversible recording medium attached to the conveying container has been shifted from an appropriate position; the conveying container conveyed at high speed has exceeded a stopper with excessive momentum; or the conveying container has been moved back in the opposite direction to the conveying direction as a result of being bumped into a stopper with excessive momentum to cause reaction against the stopper.

A rate of the misregistration caused in the aforementioned cases changes depending on performances of the conveyor line for use or the conveying container for use, but this rate is about 10 or less relative to 100 conveying containers. In view of the above, it can be considered that when the thermoreversible recording medium attached to one conveying container is irradiated with laser light emitted to rewrite an image in the thermoreversible recording medium, the laser light is emitted to the conveying container or the displayed image at most 1/10 times relative to the number of times of repetitive rewritings.

Meanwhile, in order to record as much information as possible on the thermoreversible recording medium, the information is recorded on the entire surface of the thermoreversible recording medium. Therefore, when the misregistration occurs, the laser light emitted to record information on the edges of the thermoreversible recording medium is also emitted to the conveying container. Also, in the case where the image on the thermoreversible recording medium is erased, the entire surface of the thermoreversible recording medium is irradiated with laser light in order to erase the information recorded on the entire surface of the thermoreversible recording medium. If the misregistration occurs, therefore, laser light emitted to erase the information of the edges of the thermoreversible recording medium is also emitted to the conveying container or the displayed image.

A high throughput has been desired for the conveyor line system. To this end, a conveying speed of a conveying container needs to be set as high as possible. Therefore, a conveying container is bumped into a stopper with momentum, a misregistration becomes significant. In this case, a problem that the conveying container or the displayed image is irradiated with laser light particularly easily arises.

As for one exemplary method for solving the aforementioned problem, there has been proposed a method in which a sensor configured to detect a thermoreversible recording medium is disposed on a conveyor line and, when the thermoreversible recording medium is not detected, laser light is not emitted at equal to or above a predetermined power (see Patent document 4). This method can suppress a conveying container or a displayed image from being irradiated with laser light when a thermoreversible recording medium is not attached to a position to be irradiated with laser light.

In some cases, however, the position of the thermoreversible recording medium and the position to be irradiated with laser light are misregistered. Therefore, the problem that the displayed image in the conveying container is deteriorated in visibility and machine readability by irradiating the displayed image drawn on the conveying container with laser light has not yet been solved.

Therefore, there is a need for provision of a conveyor line system capable of preventing deterioration in visibility and machine readability of an image part of a conveying container, in which a displayed image is drawn, the deterioration arising as a result of irradiation of the image part of the conveying container with laser light.

CITATION LIST

Patent Document

Patent document 1: Japanese Patent No. 5009639

Patent document 2: Japanese Unexamined Patent Application Publication No. 2010-280498

Patent document 3: Japanese Unexamined Patent Application Publication No. 2003-320692

Patent document 4: Japanese Unexamined Patent Application Publication No. 2013-111888

SUMMARY OF THE INVENTION

Technical Problem

The present invention has an object to provide a conveyor line system capable of preventing deterioration in visibility and machine readability of an image part of a conveying container, in which a displayed image is drawn, the deterioration arising as a result of irradiation of the image part of the conveying container with laser light.

Solution to Problem

As a means for solving the aforementioned problem, a conveyor line system of the present invention includes at least an image processing device. The image processing device is configured to irradiate a recording part with laser light to perform at least one of image recording and image erasing. The conveyor line system is configured to manage at least one conveying container including the recording part in which the image recording is performed by irradiation with the laser light and an image part in which a displayed image has been drawn. A formula below is satisfied at a wavelength of the laser light with which the recording part is irradiated during the image recording: $A+30>B$ where A denotes an absorbance of the recording part and B denotes an absorbance of the image part of the conveying container.

Effects of the Invention

The present invention can solve the above existing problem, achieve the above object, and provide a conveyor line system capable of preventing deterioration in visibility and machine readability of an image part of a conveying container, in which a displayed image is drawn, the deterioration arising as a result of irradiation of the image part of the conveying container with laser light.

Figure 1:
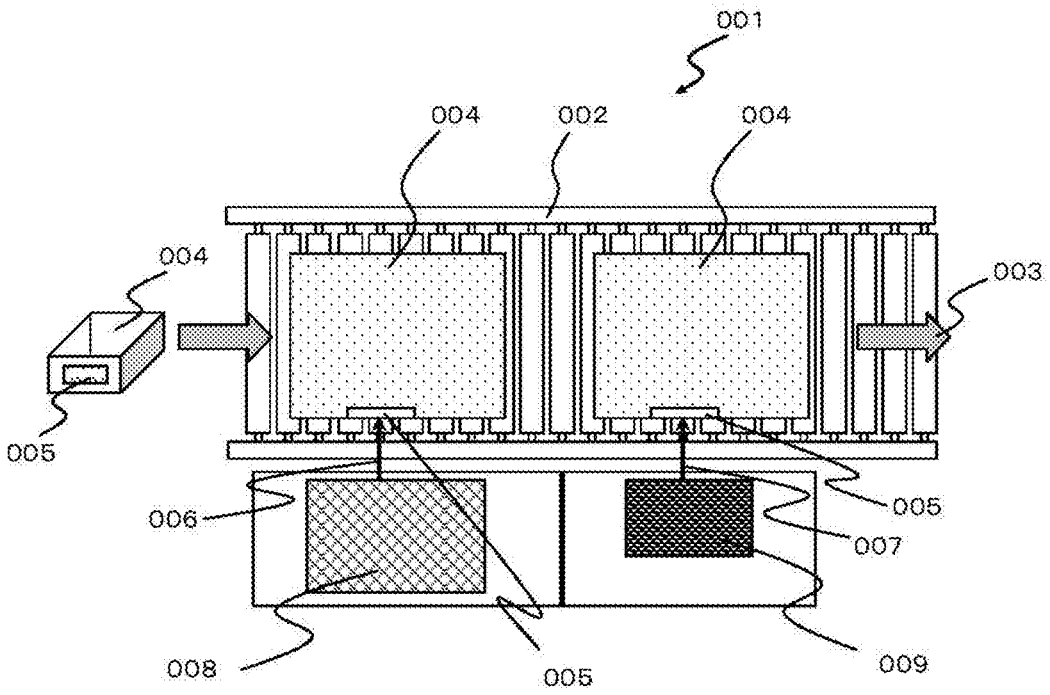
FIG. 1 is a schematic view illustrating one exemplary conveyor line system.

MODE FOR CARRYING OUT THE INVENTION (Conveyor Line System)

A conveyor line system of the present invention includes a recording part in which image recording is performed by irradiation with laser light and an image part in which a displayed image has been drawn. The conveyor line system includes at least an image processing device which is configured to irradiate the recording part with laser light to perform at least one of image recording and image erasing. The conveyor line system further includes other devices, if necessary.

The recording part in which image recording is performed by irradiation with laser light, which may be simply referred to as a recording part, refers to a region in which an image is formed by irradiation with laser light. The recording part is not particularly limited and may be appropriately selected depending on the intended purpose. Examples of the recording part include a region to which a thermoreversible recording medium is attached, a region to which a thermosensitive recording medium for single use is attached, and a region to which an ink is applied. Among them, a thermoreversible recording medium is preferable from the viewpoint of repetitive recordings.

The displayed image refers to an image which has been recorded in advance on a surface of a conveying container in order to improve a handling property and safety of the conveying container. Examples of the displayed image include company logos, alarm displays, and instructions.

The surface of the conveying container includes a recording part in which the image recording is performed by irradiation with laser light, an image part in which a displayed image has been drawn, and a non-image part which is not the recording part or the image part.

The conveyor line system is a system configured to form an image, such as contents of products placed in the conveying container, information of a delivery destination, date, and a control number, by irradiating the recording part of the conveying container moving on a conveyor line with laser light. The laser light is emitted when the recording part of the conveying container moving on the conveyor line reaches a predetermined position. The predetermined position is a position where only the recording part is irradiated with laser light from an image processing device in order to form an image in the recording part. During this operation, it is preferred that the recording part be irradiated with laser light while controlling at least one of output, a scanning speed, and a beam diameter of laser light to be emitted based on the results detected by a temperature sensor configured to detect a temperature of the recording part or an ambient temperature and a distance sensor configured to detect a distance between the recording part and the image processing device, in order to obtain a high quality image.

In the conveyor line system, energy of the laser light to be emitted depends on an absorbance of the recording part at a wavelength of the laser light.

In the present specification, the energy of the laser light to be emitted is represented by $P/(V*r)$ where P is the output of the laser light, V is the scanning speed of the laser light, and r is the spot diameter in the recording part in a direction vertical to a scanning direction of the laser light.

As the absorbance of the recording part at the wavelength of the laser light is greater, the energy of the laser light to be emitted is smaller. As the absorbance of the recording part at the wavelength of the laser light is smaller, the energy of the laser light to be emitted is greater.

When the recording part is the thermoreversible recording medium, the recording part having greater absorbance at the wavelength of the laser light includes a larger amount of a photothermal converting material configured to absorb the laser light and convert the laser light into heat. When the recording part is the ink, the recording part having greater absorbance at the wavelength of the laser light includes a larger amount of an ink to be scraped as a result of absorbing the laser light. Most of the photothermal converting materials or the inks not only absorb the wavelength of the laser light but also have absorption in the visible light region. Therefore, contrast of an image in the recording part is impaired when an amount of the photothermal converting material or the ink is increased.

As the absorbance of the recording part at the wavelength of the laser light is smaller, the output of the laser light to be emitted increases or the scanning speed of the laser light to be emitted decreases. This causes the device to be larger or reduces an image processing speed.

For the reasons mentioned above, the absorbance of the recording part is adjusted to achieve both a desired contrast of the image in the recording part and at least one of a desired size of the device and a desired processing speed of the device.

In the case where the energy of the laser light to be emitted is adjusted to be excessively high regardless of the high absorbance of the recording part at the laser light wavelength, various problems arise. For example, when used as the recording part, a thermoreversible recording medium accumulates heat to cause a white void. Alternatively, an excessively large amount of heat is generated in the thermoreversible recording medium, so that color is still developed even when it is attempted to erase the color. Meanwhile, in the case where the energy of the laser light to be emitted is adjusted to be excessively low regardless of the low absorbance of the recording part at the laser light wavelength, various problems arise as well. For example, when a thermoreversible recording medium is used as the recording part, erasion failure is caused. Alternatively, a blur image is formed.

For the reasons as mentioned above, in the conveyor line system, the recording part is irradiated with laser light having energy corresponding to a laser light absorbance of the recording part.

In the conveyor line system, as mentioned above, there is a case where not only the recording part but also the conveying container may be irradiated with laser light because a position of the recording part and a position irradiated with the laser light are mismatched. A rate of occurrence of the misregistration changes depending on a performance of the conveyor line for use or the conveying container for use, but this rate is about 100 or less relative to about 1,000 conveying containers. A rate of the conveying containers the image parts of which are irradiated with the laser light relative to all the conveying containers that are irradiated with the laser light changes depending on a performance of the conveyor line, a conveying container for use, or a position of image formation, but this rate is about 30 or less relative to about 100 conveying containers. Note that, when the entire image is less likely to be read due to, for example, blur, visibility can be considered to be deteriorated. When a region of the image part (for example, a region including a single character) is less likely to be read, visibility can also be considered to be deteriorated because image information cannot be obtained.

In the case where an image is irradiated with laser light, a part of the image is irradiated with the laser light more frequently than the entire image. Although the number of laser light irradiations required to irradiate the entirety of a region in the image with the laser light once changes depending on a laser light irradiation pattern, a position of image formation, and a shape of the image, it is necessary to irradiate the image with laser light about three or more times. Thus, it can be considered that laser light emitted to rewrite an image in the recording part of one conveying container is emitted to one region of the image formed on the conveying container at most 1/100 times relative to the number of times of repetitive rewritings.

The conveyor line system of the present invention includes at least an image processing device. The image processing device is configured to irradiate a recording part with laser light to perform at least one of image recording and image erasing. The conveyor line system is configured to manage a conveying container including: the recording part in which the image recording is performed by irradiation with the laser light; and an image part in which a displayed image has been drawn. A formula below is satisfied at a wavelength of the laser light with which the recording part is irradiated during the image recording: $A+30>B$ where A denotes an absorbance of the recording part and B denotes an absorbance of the image part of the conveying container.

The displayed image refers to at least one of visible information and a machine readable image. The visible information refers to an image of which information is visually read. Examples of the visible information include characters and symbols. The machine readable image refers to an image to be read by a dedicated reading device. Examples of the machine readable image include barcodes, two-dimensional codes, and OCR.

In order to reduce the possibility of deterioration in visibility and machine readability of the image part of the conveying container, a formula: $A+10>B$ is preferably satisfied and a formula: $A>B$ is more preferably satisfied.

When the absorbance A of the recording part and the absorbance B of the image part of the conveying container satisfy a formula: $A+30\leq B$, an amount of heat generated in the image part of the conveying container is large. Therefore, when the image part of the conveying container is irradiated with laser light repeatedly, the image part may be more likely to be deteriorated in visibility and machine readability.

The absorbance is a value determined by a formula below. For example, the absorbance of the recording part is determined in this manner.

$$\text{Absorbance (\%)}=100-\text{reflectance (\%)}$$

The reflectance is a measured value measured by means of an integrating sphere visible-near IR spectrophotometer, relative to 100% of the reflectance of a $BaSO_4$ white board.

The reflectance may be measured by means of an integrating sphere visible-near IR spectrophotometer, relative to 100% of the reflectance of a $BaSO_4$ white board. Measurement devices for measuring the reflectance are not particularly limited, but devices capable of measuring a small measurement region (e.g., SOLIDSPEC-3700, available from SHIMADZU CORPORATION) are preferably used when measuring the reflectance of a conveying container on which an image having a small image region (e.g., a narrow character) is recorded.

The absorbance of the image part of the conveying container is a value determined according to a formula below:

$$\text{Absorbance of image part of conveying container (\%)}=100\times(1-C/D)$$

where C (%) denotes the reflectance of the image part of the conveying container in which the displayed image has been drawn, and D (%) denotes the reflectance of the non-image part of the conveying container, in which the displayed image is not drawn, with the proviso that when $C>B$, the absorbance of the image part of the conveying container is determined as 0(%).

At the wavelength of laser light to be emitted, the absorbance of the image part of the conveying container, in which the image has been recorded, is smaller than the absorbance of the recording part. Thus, even when not only the recording part but also the conveying container, on which the image has been recorded, is irradiated with laser light, an amount of heat generated through absorption of the laser light by the image is small due to a low laser light absorbance of the image part. This reduces the possibility of deterioration in visibility or machine readability of the displayed image due to scrapes of the image caused by the heat generated. Moreover, because the absorbance of the image part of the conveying container, in which the image has been recorded, is smaller than the absorbance of the recording part, thermal deterioration caused by laser light irradiation is less likely to occur in the image part than in the recording part. Therefore, in the case of using a thermoreversible recording medium as the recording part, for example, even when the thermoreversible recording medium cannot be used due to thermal deterioration, the conveying container can be continuously used by attaching a new thermoreversible recording medium to the conveying container. On the contrary, when the image is thermally deteriorated to be unusable earlier than the thermoreversible recording medium, it is necessary to reattach the thermoreversible recording medium to a new conveying container. In this case, however, because the thermoreversible recording medium is often fixed in the conveying container with a strong bonding agent or a strong adhesive so that the thermoreversible recording medium is not easily peeled from the conveying container, lines or scratches may be formed on the thermoreversible recording medium, or the thermoreversible recording medium may be bended, or a bending mark may be left at a time when the thermoreversible recording medium is peeled from the conveying container to be replaced. Therefore, the thermoreversible recording medium cannot be reused by being attached to a new conveying container.

In the present invention, in the case where an image recorded by the image recording device includes at least a solid image, it is particularly effective for preventing deterioration in visibility or machine readability of the displayed image that the absorbance of the image part of the conveying container, in which the image has been recorded, be smaller than the absorbance of the recording part at the wavelength of the laser light to be emitted. This is because the solid image is recorded by drawing at least a plurality of lines with laser light so as to overlap or be adjacent to each other. As a result, heat is accumulated in a region, which is irradiated with the laser light, of the conveying container and a larger amount of heat is generated in the solid image as compared with an image formed with a single line. In this case, therefore, the image part of the conveying container is easily scraped.

The solid image means an image formed by overlapping at least a plurality of lines drawn by laser light or an image formed by drawing at least a plurality of lines with laser light so as to be adjacent to each other. Examples of the solid image include: two-dimensional codes such as barcodes and QR codes (registered trademark); outline characters; bold letters; logotypes; symbols; figures; and pictures. Among them, barcodes are suitable as the solid image to be formed in the recording part used in the conveyor line system.

Examples of the barcodes include ITF, Code 128, Code 39, JAN, EAN, UPC, and NW-7.

When an image recorded by the image recording device includes at least a solid image, it is preferable to adjust an image recording pattern so as to form the solid image at a center of the recording part. In the case where the image includes a plurality of solid images, moreover, it is particularly preferable to adjust an image recording pattern so as to form an image at a center of the recording part, with the increase in the number of lines, which are drawn by laser light and constitute the solid image.

In the case where the solid image is formed at a center of the recording part, even when there is a misregistration or timing deviation of laser light irradiation, a probability that the image is irradiated with laser light used for forming the solid image can be reduced. As a result, deterioration in visibility or machine readability of the displayed image can be prevented as compared with a case where the solid image is formed at a peripheral part of the recording part.

Assuming that the maximum distance is 100 among distances between any 2 points in the recording part, the minimum distance among distances between any side of the recording part and the solid image is preferably 10 or more, more preferably 20 or more, further preferably 40 or more.

In the present invention, it is preferable to form the recording part away from the image part of the conveying container, in which the displayed image is drawn.

In the case where a distance between the image part and the recording part of the conveying container is lengthened, even when there is a misregistration or timing deviation of laser light irradiation, a probability that the image is irradiated with laser light used for forming the solid image can be reduced.

The distance between the image part and the recording part of the conveying container refers to the minimum distance among distances between any point on the image part and any point in the recording part of the conveying container. Assuming that the maximum distance is 100 among distances between any 2 points in the recording part, the distance between the image part and the recording part in the conveying container is preferably 20 or more, more preferably 50 or more, further preferably 100 or more.

In the case where the conveyor line system stops the conveying container at a predetermined position before reaching the image processing device using at least a stopper, it is preferable that the absorbance of the image part of the conveying container be smaller than the absorbance of the recording part at the wavelength of laser light to be emitted.

In the conveyor line system, the conveying container may be irradiated with the laser light without stopping the conveying container before reaching the image processing device. If the laser light is emitted without stopping the conveying container, however, image quality of an image formed in the recording part may become low due to vibration of the conveyor line system. Therefore, the laser light is preferably emitted with stopping the conveying container before reaching the image processing device.

As for a method for stopping the conveying container before reaching the image processing device, there is a method where the conveying container is stopped without using a stopper. However, the conveying container is preferably stopped with a stopper, because the conveying container may slide to cause misregistration at a time when the conveyor line is stopped.

The stopper refers to a member configured to stop the conveying container at a predetermined position before reaching the image processing device. A constituting material of the stopper may be appropriately selected, but the stopper preferably includes a material having a low absorbance at the wavelength of laser light to be emitted.

The stopper may be a movable stopper or a fixed stopper, and the stopper may be appropriately selected depending on the intended purpose.

The fixed stopper includes a mechanism configured to make the conveying container exceed the fixed stopper after the completion of the image processing. The fixed stopper requires a modification for changing a conveying direction of the conveyor line before or after stopping the conveying container. Therefore, the stopper is preferably the movable stopper configured to operate to stop the conveying container on the conveyor line only when the conveying container approaches a stopping position of the conveying container.

In the case where the conveying container is stopped with the stopper, some problems may occur, for example, the conveying container may exceed the stopper due to excessive force and the conveying container is bumped into the stopper with excessive speed to move back in the opposite direction to the conveying direction due to the reaction against the stopper, when a conveying speed of the conveying container is increased to realize high throughput. In such a case, when the misregistration of the conveying container is caused, the conveying container and the image part are irradiated with laser light. This problem is more likely to occur as the throughput is greater.

When the conveyor line system is configured to stop the conveying container before reaching the image processing device with at least the stopper, therefore, the image part of the conveying container can be prevented from deteriorating in visibility and machine readability by making the absorbance of the image part of the conveying container smaller than the absorbance of the recording part at the wavelength of laser light to be emitted. In the case where the throughput required for the conveyor line system is large, it is preferable that the absorbance of the image part of the conveying container be smaller than the absorbance of the recording part, as compared with the case where the throughput is small. It is particularly preferable that the absorbance of the image part of the conveying container be smaller than the absorbance of the recording part, as the throughput required for the conveyor line system is greater.

Moreover, the degree of misregistration of the conveying container caused by the stopper varies depending on a material of the stopper, a material of the conveying container, a weight of the conveying container, and a speed of the conveyor line in accordance with the number of the conveying containers per time processed by the conveyor line, the number depending on a conveying performance of the conveyor, a printing processing time, and an erasing processing time. It is preferable that the aforementioned conditions be set so that the degree of the misregistration is as small as possible.

As for the arrangement of the image processing device, an image erasing device and an image recording device are disposed in this order from an upstream of the conveyer line, as illustrated in FIG. 1. The image erasing device and the image recording device are preferably disposed adjacent to each other. The phrase "adjacent to each other" means a state where the image erasing device and the image recording device are disposed as close to each other as possible, so long as the arrangement does not affect image recording or image erasing performed by irradiating the recording part with laser light, does not affect conveyance of the conveying container moving on the conveyor line, and does not affect an arrangement of a control means, which is configured to control laser light to be emitted based on a result detected by a temperature sensor or a distance sensor, a power source cord, and a wire. It is not necessary that the image erasing device and the image recording device be in contact with each other.

By employing the above-mentioned arrangement, it is possible to reduce the size of a safety cover for preventing the laser light from leaking to the surroundings as compared with a case where the image erasing device is disposed away from the image recording device. Moreover, in the case where the misregistration of the conveying container occurs as described above at a time when an image is recorded in the recording part, so that a barcode, which is an information reading code, is not accurately recorded to cause a reading error in an information reading device disposed downstream of the image recording device, it is necessary to perform image erasion and image recording again in the conveying container causing the reading error and the subsequent conveying containers. In the case where the image erasing device and the image recording device are disposed adjacent to each other, the number of the conveying containers on which image processing is performed again can be reduced as compared with a case where the image erasing device is disposed away from the image recording device. Therefore, more images in the recording parts of the conveying containers can be rewritten within a shorter period.

An image processing device and a recording part, which are suitably used for the present invention, will now be described in detail.

<Image Processing Device>

The image processing device includes an image recording device and an image erasing device. The image recording device and the image erasing device may be integrated or mounted as separate bodies.

<<Image Recording Device>>

The image recording device is not particularly limited and may be appropriately selected depending on the intended purpose, so long as the image recording device includes a means configured to record an image using laser light.

The image recording device includes at least a laser-light irradiating means and, if necessary, further includes appropriately selected other members.

In the present invention, it is necessary to select a wavelength of laser light to be emitted so that a recording part, on which an image is formed, absorbs the laser light at high efficiency. For example, in the case where a thermoreversible recording medium is used as the recording part, the thermoreversible recording medium includes at least a photothermal converting material which has a function of absorbing laser light at high efficiency to generate heat. Therefore, it is necessary to select the wavelength of the laser light to be emitted so that the photothermal converting material absorbs the laser light at the highest efficiency as compared with other materials.

—Laser-light Emitting Means—

The laser-light emitting means may be appropriately selected depending on the intended purpose. Examples of the laser-light emitting means include semiconductor lasers, solid lasers, and fiber lasers. Among them, semiconductor lasers are particularly preferable because the semiconductor lasers have wide wavelength selectability. In addition, the semiconductor lasers can be downsized and can be made inexpensive because the semiconductor lasers include small laser light sources.

The wavelength of semiconductor laser light, solid laser light, or fiber laser light emitted from the laser-light emitting means is preferably 700 nm or greater, more preferably 720 nm or greater, further preferably 750 nm or greater. The upper limit of the wavelength of the laser light may be appropriately selected depending on the intended purpose, but is preferably 1,600 nm or shorter, more preferably 1,300 mm or shorter, particularly preferably 1,200 nm or shorter.

In the case where a thermoreversible recording medium is used as the recording part, the laser light having a wavelength of shorter than 700 nm causes the following problems. Specifically, in the visible light region, image contrast is reduced, and the thermoreversible recording medium is colored during image recording on the thermoreversible recording medium. In the UV light region of which wavelengths are further shorter, the thermoreversible recording medium tends to be deteriorated. Moreover, the photothermal converting material to be added to the thermoreversible recording medium needs to have a high decomposition temperature in order to ensure durability against repetitive image processing. In the case where an organic pigment is used for the photothermal converting material, it is difficult to obtain a photothermal converting material having a high decomposition temperature and a long absorption wavelength. For the reasons as mentioned, the wavelength of the laser light is preferably 1,600 nm or shorter.

Output of the laser light emitted in an image recording step by the image recording device is not particularly limited and may be appropriately selected depending on the intended purpose, but is preferably 1 W or greater, more preferably 3 W or greater, particularly preferably 5 W or greater. When the output of the laser light is less than 1 W, it takes a long time to record an image, or the output may be insufficient when it is attempted to reduce an image recording time.

Moreover, the upper limit of the output of the laser light is not particularly limited and may be appropriately selected depending on the intended purpose, but is preferably 200 W or lower, more preferably 150 W or lower, particularly preferably 100 W or lower. When the upper limit of the output of the laser light is greater than 200 W, the size of a laser device may become large.

A scanning speed of the laser to be emitted in the image recording step is not particularly limited and may be appropriately selected depending on the intended purpose, but is preferably 100 mm/s or greater, more preferably 300 mm/s or greater, particularly preferably 500 mm/s or greater. When the scanning speed is less than 100 mm/s, it may take a long time to record an image.

Moreover, the upper limit of the scanning speed of the laser light is not particularly limited and may be appropriately selected depending on the intended purpose, but is preferably 15,000 mm/s or less, more preferably 10,000 mm/s or less, particularly preferably 8,000 mm/s or less.

When the scanning speed is greater than 15,000 mm/s, it may be difficult to form a uniform image.

A spot diameter of the laser light to be emitted in the image recording step is not particularly limited and may be appropriately selected depending on the intended purpose, but is preferably 0.02 mm or greater, more preferably 0.1 mm or greater, particularly preferably 0.15 mm or greater. When the spot diameter is less than 0.02 mm, a line width of an image becomes narrow, and thus visibility of the image is lowered.

Moreover, the upper limit of the spot diameter of the laser light is not particularly limited and may be appropriately selected depending on the intended purpose, but is preferably 3.0 mm or less, more preferably 2.5 mm or less, particularly preferably 2.0 mm or less. When the spot diameter is greater than 3.0 mm, a line width of an image becomes large, so that adjacent lines are overlapped. Therefore, it may become impossible to record a small-sized image.

Other factors of the image recording device are not particularly limited, and those described in the present invention and factors known in the art can be applied.

Figure 2:
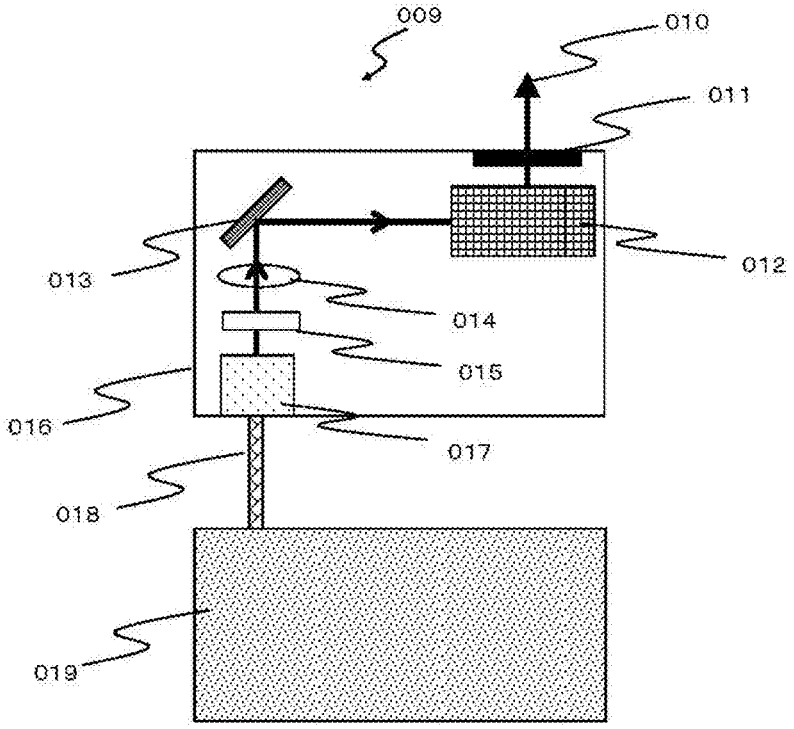
FIG. 2 is a view illustrating one exemplary image recording device.

FIG. 2 is a schematic view illustrating one exemplary image recording device 009. This device uses a fiber-coupled LD which includes a LD array including a plurality of LD light sources, a special optical lens system configured to convert a linear beam emitted from the LD array into a circular beam, and optical fibers. Use of the fiber-coupled LD enables to emit a small circular beam at high output and to print a small character with a fine line at high speed.

When the fiber-coupled LD is used, a control section including a LD light source, a power source system, and a control system can be disposed away from an optical head including a galvanometer mirror unit 012 configured to scan laser light on the thermoreversible recording medium at high speed.

As for a position of an emitting outlet of the optical head, it is necessary to extend a light path as long as possible in order to reduce a beam diameter of laser light to be emitted to the galvanometer mirror unit 012. This is because the galvanometer mirror needs to be large when the beam diameter is large, leading to inaccurate printing. In order to ensure a light path as long as possible without increasing the size of the optical head, the emitting outlet 011 of the laser light is disposed at an edge of the optical head, as well as using a reflective mirror 013.

Note that, in FIG. 2, reference numeral 010 denotes laser light emitted from the image recording device, reference numeral 014 denotes a condenser lens, reference numeral 015 denotes a focal position correcting unit, reference numeral 016 denotes a housing of the optical head of the image recording device, reference numeral 017 denotes a collimator lens unit, reference numeral 018 denotes an optical fiber, and reference numeral 019 denotes a control section of the image recording device.

<<Image Erasing Device>>

In the case where a thermoreversible recording medium is used as the recording part, an image erasing device configured to heat the thermoreversible recording medium to erase an image is not particularly limited and may be appropriately selected depending on the intended purpose. Examples of the image erasing device include non-contact heating devices using laser light, hot air, warm water, or an IR heater, and contact heating devices using a thermal head, a hot stamp, a heat block, or a heat roller. Among them, an image erasing device configured to irradiate a thermoreversible recording medium with laser light from a laser-light emitting means is particularly preferable.

The laser-light emitting means is not particularly limited and may be appropriately selected depending on the intended purpose. Examples of the laser-light emitting means include semiconductor lasers, solid lasers, fiber lasers, and $CO_2$ lasers. Among them, semiconductor lasers are particularly preferable because the semiconductor lasers have wide wavelength selectability. In addition, the semiconductor lasers can be downsized and can be made inexpensive because the semiconductor lasers include small laser light sources.

In order to uniformly erase an image within a short period, the image erasing device includes at least a semiconductor laser array, a width-direction collimating means, and a length-direction light-distribution control means, preferably further includes a beam-size adjusting means and a scanning means, and more preferably further includes other means, as necessary.

As one exemplary image erasing device, an image erasing device including at least a semiconductor laser array, a width-direction collimating means, and a length-direction light-distribution control means will now be described.

With the image erasing device, an image which has been recorded on a thermoreversible recording medium, a color tone of which reversibly changes depending on a temperature, is erased by irradiating the thermoreversible recording medium with a linear beam, which is longer than a length of a light source of the semiconductor laser array and has a uniform light distribution in a length direction, to heat the thermoreversible recording medium.

The image erasing method includes at least a width-direction collimating step and a length-direction light-distribution control step and further includes a beam-size adjusting step, a scanning step, and other steps, as necessary. The image erasing method is a method where an image which has been recorded on a thermoreversible recording medium, a color tone of which reversibly changes depending on a temperature, is erased by irradiating the thermoreversible recording medium with a linear beam, which is longer than a length of a light source of the semiconductor laser array and has a uniform light distribution in a length direction, to heat the thermoreversible recording medium.

The image erasing method can be suitably performed by the image erasing device. The width-direction collimating step can be performed by the width-direction collimating means, the length-direction light-distribution control step can be performed by the length-direction light-distribution control means, the beam-size adjusting step can be performed by the beam-size adjusting means, the scanning step can be performed by the scanning means, and the other steps can be performed by the other means.

—Semiconductor Laser Array—

The semiconductor laser array is a semiconductor laser light source in which a plurality of semiconductor lasers are linearly aligned. The semiconductor laser array preferably includes from 3 through 300 semiconductor lasers, more preferably from 10 through 100 semiconductor lasers.

When the number of the semiconductor lasers is small, it may not be able to increase irradiation power. When the number is excessively large, it may be necessary to provide a large-scale cooling device configured to cool the semiconductor laser array. Note that, the semiconductor lasers are needed to be heated in order to allow the semiconductor laser array to emit light. As a result, the semiconductor lasers are needed to be cooled. Therefore, cost for the device may increase.

A length of the light source of the semiconductor laser array is not particularly limited and may be appropriately selected depending on the intended purpose, but is preferably from 1 mm through 50 mm, more preferably from 3 mm through 15 mm. When the length of the light source of the semiconductor laser array is less than 1 mm, the irradiation power cannot be increased. When the length is greater than 50 mm, it is necessary to provide a large-scale cooling device configured to cool the semiconductor laser array. This may lead to increased cost for the device.

A wavelength of the laser light emitted from the semiconductor laser array is preferably 700 nm or greater, more preferably 720 nm or greater, further preferably 750 nm or greater. The upper limit of the wavelength of the laser light may be appropriately selected depending on the intended purpose, but is preferably 1,600 nm or shorter, more preferably 1,300 mm or shorter, further preferably 1,200 nm or shorter.

In the case where a thermoreversible recording medium is used as the recording part, the laser light having a wavelength of shorter than 700 nm causes the following problems. Specifically, in the visible light region, image contrast is reduced, and the thermoreversible recording medium is colored during image recording on the thermoreversible recording medium. In the UV light region of which wavelengths are further shorter, the thermoreversible recording medium tends to be deteriorated. Moreover, the photothermal converting material to be added to the thermoreversible recording medium needs to have a high decomposition temperature in order to ensure durability against repetitive image processing. In the case where an organic pigment is used for the photothermal converting material, it is difficult to obtain a photothermal converting material having a high decomposition temperature and a long absorption wavelength. For the reasons as mentioned, the wavelength of the laser light is preferably 1,600 nm or shorter.

—Width-direction Collimating Step and Width-direction Collimating Means—

The width-direction collimating step is a step of collimating a width-direction spread of the laser light emitted from the semiconductor laser array, in which a plurality of the semiconductor lasers are linearly aligned, to be transformed into a linear beam. The width-direction collimating step can be performed by the width-direction collimating means.

The width-direction collimating means is not particularly limited and may be appropriately selected depending on the intended purpose. Examples of the width-direction collimating means include a single one-side convex cylindrical lens and a combination of a plurality of convex cylindrical lenses.

The laser light emitted from the semiconductor laser array has a larger divergence angle in a width direction than in a length direction. When the width-direction collimating means is disposed adjacent to an emission surface of the semiconductor laser array, a beam width can be prevented from becoming large and a lens can be downsized. Therefore, such an arrangement is preferable.

—Length-direction Light-distribution Control Step and Length-direction Light-distribution Control Means—

A length-direction light-distribution control step is a step of making the length of the linear beam formed in the width-direction collimating step longer than the length of the light source of the semiconductor laser array and giving a uniform light distribution in the length direction. The length-direction light-distribution control step can be performed by the length-direction light-distribution control means.

The length-direction light-distribution control means is not particularly limited and may be appropriately selected depending on the intended purpose. For example, the length-direction light-distribution control means can include two spherical lenses or a combination of an aspherical cylindrical lens (length direction) and a cylindrical lens (width direction). Examples of the aspherical cylindrical lens (length direction) include Fresnel lenses, convex lens arrays, and concave lens arrays.

The light-distribution uniformizing means is disposed at an emission surface side of the collimating means.

—Beam-size Adjusting Step and Beam-size Adjusting Means—

For example, in the case where a thermoreversible recording medium is used as the recording part, the beam-size adjusting step is a step of adjusting at least one of a length and a width of the linear beam on the thermoreversible recording medium, the linear beam being longer than the length of the light source of the semiconductor laser array and having a uniform light distribution in a length direction. The beam-size adjusting step can be performed by the beam-size adjusting means.

The beam-size adjusting means is not particularly limited and may be appropriately selected depending on the intended purpose. Examples of the beam-size adjusting means include means configured to change a focal length of a cylindrical lens or a spherical lens, means configured to change an installation position of the lens, and means configured to change a work distance between the device and the thermoreversible recording medium.

A length of the linear beam which has been adjusted is preferably from 10 mm through 300 mm, more preferably from 30 mm through 160 mm. Because an erasable region is determined by the length of the beam, the erasable region is small when the length is narrow. When a width of the linear beam is large, energy is also applied to a region that does not need to be erased, and thus energy loss or damage may be caused.

The length of the beam is preferably 2 times or more, more preferably 3 times or more longer than the length of the light source of the semiconductor laser array. When the length of the beam is shorter than the length of the light source of the semiconductor laser array, it is necessary to make the light source of the semiconductor laser array long in order to ensure a long erasion region. This may lead to increased cost or enlarged size of the device.

Moreover, a width of the linear beam which has been adjusted is preferably from 0.1 mm through 10 mm, more preferably from 0.2 mm through 5 mm. The width of the beam can control duration for heating the thermoreversible recording medium. When the width of the beam is narrow, the duration for heating is short, leading to deteriorated erasability. When the width of the beam is large, the duration for heating is long. As a result, excessive energy is applied to the thermoreversible recording medium and high energy is required to perform erasion at high speed. Therefore, the device needs to adjust the width of the beam to be suitable for an erasion property of the thermoreversible recording medium.

Output of the linear beam that has been adjusted as described above is not particularly limited and may be appropriately selected depending on the intended purpose, but is preferably 10 W or greater, more preferably 20 W or greater, further preferably 40 W or greater. When the output of the linear beam is less than 10 W, it takes a long time to erase an image, or the output is insufficient when it is attempted to shorten an image erasing time. This may lead to erasing failure. Moreover, the upper limit of the output of the laser light is not particularly limited and may be appropriately selected depending on the intended purpose, but is preferably 500 W or less, more preferably 200 W or less, further preferably 120 W or less. When the output of the laser light is greater than 500 W, a cooling device for the light source of the semiconductor laser may need to be large.

—Scanning Step and Scanning Means—

In the case where a thermoreversible recording medium is used as the recording part, for example, the scanning step is a step of scanning the linear beam, which is longer than the length of the light source of the semiconductor laser array and has a uniform light distribution in a length direction, on the thermoreversible recording medium along a monoaxial direction. The scanning step can be performed by the scanning means.

The scanning means is not particularly limited and may be appropriately selected depending on the intended purpose, so long as the scanning means can scan the linear beam along a monoaxial direction. Examples of the scanning means include monoaxial galvanometer mirrors, polygon mirrors, and stepping motor mirrors.

Monoaxial galvanometer mirrors and stepping motor mirrors can adjust a scanning speed finely. It is difficult for polygon mirrors to adjust a scanning speed, but polygon mirrors are advantageously inexpensive.

A scanning speed of the linear beam is not particularly limited and may be appropriately selected depending on the intended purpose, but is preferably 2 mm/s or greater, more preferably 10 mm/s or greater, further preferably 20 mm/s or greater. When the scanning speed is less than 2 mm/s, it takes a long time to erase an image. Moreover, the upper limit of the scanning speed of the laser light is not particularly limited and may be appropriately selected depending on the intended purpose, but is preferably 1,000 mm/s or less, more preferably 300 mm/s or less, further 100 mm/s or less. When the scanning speed is greater than 1,000 mm/s, it may be difficult to uniformly erase an image.

Moreover, it is preferable that an image recorded on a thermoreversible recording medium be erased by moving the thermoreversible recording medium by means of a moving means relative to a linear beam, which is longer than the length of the light source of the semiconductor laser array and has a uniform light distribution in a length direction, to scan the linear beam on the thermoreversible recording medium.

Examples of the moving means include conveyors and stages. In this case, it is preferable that the thermoreversible recording medium, which has been attached to a surface of a box, be moved by moving the box by the conveyor.

—Other Steps and Other Means—

The other steps are not particularly limited and may be appropriately selected depending on the intended purpose. Examples of the other steps include a control step.

The other means are not particularly limited and may be appropriately selected depending on the intended purpose. Examples of the other means include a control means.

The control step is a step of controlling each of the steps and can be suitably performed by the control means.

The control means is not particularly limited and may be appropriately selected depending on the intended purpose, so long as the control means can control operation of each of the means. Examples of the control means include devices such as sequencers and computers.

Other factors of the image erasing device are not particularly limited, and those described in the present invention and factors known in the art can be applied.

Figure 3:
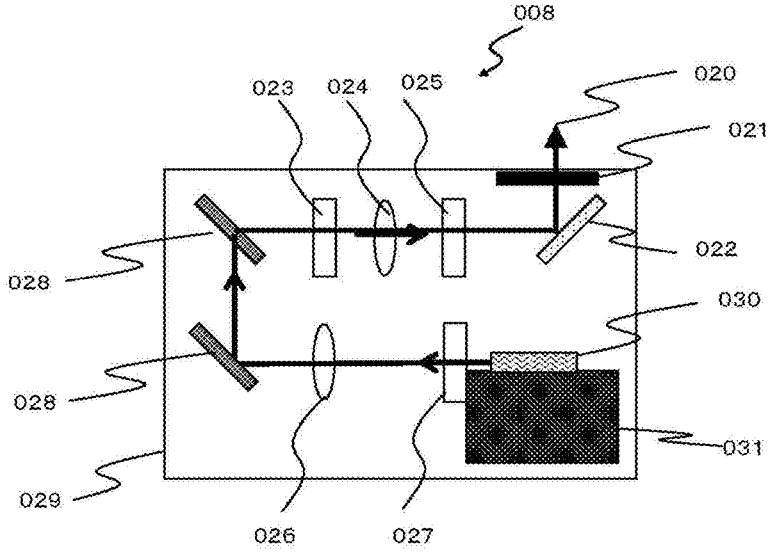
FIG. 3 is a view illustrating one exemplary image erasing device.

FIG. 3 illustrates one exemplary image erasing device 008 including at least a semiconductor laser array 030, a width-direction collimating means 027, and a length-direction light-distribution control means 026, as described above.

The image erasing device 008 includes the width-direction collimating means 027, the length-direction light-distribution control means 026, beam-width adjusting means 023, 024, and 025, and a scanning mirror 022 serving as the scanning means. Therefore, a long light path is required. In order to ensure a light path as long as possible without increasing the size of the image erasing device, therefore, the emitting outlet 021 of the laser light is disposed at an edge of the image erasing device, as well as disposing a light path in the "C" shape using a reflective mirror 028.

Note that, in FIG. 3, reference numeral 020 denotes laser light emitted from the image erasing device, reference numeral 029 denotes a housing of the image erasing device, and reference numeral 031 denotes a cooling unit.

<Recording Part>

The recording part is a region which is irradiated with laser light to form an image. The recording part is not particularly limited and may be appropriately selected depending on the intended purpose. Examples of the recording part include thermoreversible recording media, irreversible thermosensitive recording media, and recording inks. Among them, thermoreversible recording media, on which image recording can be repeatedly performed, is particularly preferable.

<<Thermoreversible Recording Medium>>

The thermoreversible recording medium includes a support and a thermoreversible recording layer on the support, and, if necessary, further includes appropriately selected other layers such as a photothermal converting layer, a first oxygen barrier layer, a second oxygen barrier layer, a UV ray absorbing layer, a back layer, a protective layer, an intermediate layer, an undercoat layer, an adhesive layer, a bonding agent layer, a coloring layer, an air layer, and a light reflective layer. Each of these layers may have a single layer structure or a laminate structure.

However, the photothermal converting material may be included in at least one of the thermoreversible recording layer and a layer adjacent to the thermoreversible recording layer. In the case where the photothermal converting material is included in the thermoreversible recording layer, the thermoreversible recording layer also serves as the photothermal converting layer. As for a layer disposed on the photothermal converting layer, it is preferable that the layer include a material that hardly absorbs light of a specific wavelength to be emitted, in order to reduce energy loss of laser light of the specific wavelength.

—Support—

A shape, a structure, and a size of the support are not particularly limited and may be appropriately selected depending on the intended purpose. Examples of the shape include a plate shape. The structure may be a single layer structure or a laminate structure. The size may be appropriately selected depending on the size of the thermoreversible recording medium.

—Thermoreversible Recording Layer—

The thermoreversible recording layer includes a leuco dye, which is an electron-donating coloring compound, and a color developer, which is an electron-accepting compound. The thermoreversible recording layer is a thermoreversible recording layer configured to reversibly change in a color tone upon application of heat. The thermoreversible recording layer further includes a binder resin, and, if necessary, further includes other components.

The leuco dye, which is an electron-donating coloring compound which reversibly changes in a color tone upon application of heat, and a reversible color developer, which is an electron accepting compound, are materials which can realize reversible visual change depending on change in temperature. The leuco dye and the color developer can relatively change between a colored state and an erased state according to differences in a heating temperature and a cooling speed after heating.

—Leuco Dye—

The leuco dye itself is a colorless or pale dye precursor. The leuco dye is not particularly limited and may be appropriately selected from those known in the art. Suitable examples of the leuco dye include triphenylmethane phthalide-based leuco compounds, triallyl-methane-based leuco compounds, fluoran-based leuco compounds, phenothiazine-based leuco compounds, thiofluoran-based leuco compounds, xanthene-based leuco compounds, indophthalyl-based leuco compounds, spiropyran-based leuco compounds, azaphthalide-based leuco compounds, couromemopyrazole-based leuco compounds, methine-based leuco compounds, Rhodamine-anilinolactam-based leuco compounds, Rhodamine-lactam-based leuco compounds, quinazoline-based leuco compounds, diazaxanthene-based leuco compounds, and bislactone-based leuco compounds. Among them, fluoran-based leuco dyes or phthalide-based leuco dyes are particularly preferable from the viewpoint of being excellent in a coloring-erasing property, color, and a preservation property.

—Reversible Color Developer—

The reversible color developer is not particularly limited and may be appropriately selected depending on the intended purpose, so long as the reversible color developer can reversibly color and erase using heat as a factor. Suitable examples of the reversible color developer include compounds including, in a molecule, one or more structures selected from (1) a structure having an ability to color the leuco dye (e.g., a phenolic hydroxyl group, a carboxylic acid group, and a phosphoric acid group) and (2) a structure for controlling aggregation force between molecules (e.g., a structure linked with a long-chain hydrocarbon group). Note that, the linking may be via a bivalent or higher linking group including a hetero atom, and the long-chain hydrocarbon group may include at least one of the same linking group as described above and an aromatic group.

The (1) structure having an ability to color the leuco dye is particularly preferably phenol.

The (2) structure for controlling aggregation force between molecules is preferably a long-chain hydrocarbon group including 8 or more carbon atoms, more preferably a long-chain hydrocarbon group including 11 or more carbon atoms. Moreover, the upper limit of the number of carbon atoms is preferably 40 or less, more preferably 30 or less.

The electron accepting compound (color developer) is preferably used in combination with a compound including at least one of a —NHCO— group and a —OCONH— group in a molecule, as an erasion accelerator. This is because an intermolecular interaction between the erasion accelerator and the color developer in the process of forming an erased state can be induced to improve a coloring and erasing property.

The erasion accelerator is not particularly limited and may be appropriately selected depending on the intended purpose.

The thermoreversible recording layer may include a binder resin, and, if necessary, may further include various additives for improving or controlling coatability or a coloring and erasing property of the thermoreversible recording layer. Examples of the additives include surfactants, conductive agents, fillers, antioxidants, photostabilizers, coloring stabilizers, and erasion accelerators.

—Binder Resin—

The binder resin is not particularly limited and may be appropriately selected depending on the intended purpose, so long as the binder rein can bind the thermoreversible recording layer onto a support. One or two or more selected from resins known in the art can be used in combination as the binder resin. Among them, resins curable by heat, UV rays, or electron beams are preferably used and thermosetting resins using an isocyanate-based compound as a cross-linking agent are particularly suitable, in order to improve durability to repetitive use.

—Photothermal Converting Layer—

The photothermal converting layer includes at least a photothermal converting material which has a function of highly efficiently absorbing the laser light to generate heat. The photothermal converting material may be included in at least one of the thermoreversible recording layer and a layer adjacent to the thermoreversible recording layer. In the case where the photothermal converting material is included in the thermoreversible recording layer, the thermoreversible recording layer also serves as the photothermal converting layer. Moreover, a barrier layer may be formed between the thermoreversible recording layer and the photothermal converting layer for the purpose of preventing an interaction between the thermoreversible recording layer and the photothermal converting layer. The barrier layer is preferably formed of a material having excellent heat conductivity. A layer sandwiched between the thermoreversible recording layer and the photothermal converting layer is not particularly limited and may be appropriately selected depending on the intended purpose.

The photothermal converting material is roughly classified into an inorganic material and an organic material.

The inorganic material is not particularly limited and may be appropriately selected depending on the intended purpose. Examples of the inorganic material include carbon black; metals (e.g., Ge, Bi, In, Te, Se, and Cr) or semimetals; alloys including the above-described metals or semimetals, metal boride particles, and metal oxide particles.

Suitable examples of the metal boride and the metal oxide include hexaborides, tungsten oxide compounds, antimony-doped tin oxide (ATO), tin-doped indium oxide (ITO), and zinc antimonate.

The organic material is not particularly limited and various dyes can be appropriately used depending on the wavelength of light to be absorbed. In the case where a semiconductor laser is used as a light source, a near infrared-absorbing dye having an absorption peak in a wavelength range of from 700 nm through 1,600 nm is used. Specific examples of the near infrared-absorbing dye include cyanine dyes, quinine-based dyes, quinoline derivatives of indonaphthol, phenylene-diamine-based nickel complexes, and phthalocyanine-based compounds. In order to perform the image processing repeatedly, a photothermal converting material having excellent heat resistance is preferably selected. In this point of view, phthalocyanine-based compounds are particularly preferable.

The near infrared-absorbing dyes may be used alone or in combination.

In the case where the photothermal converting layer is included, the photothermal converting material is typically used in combination with a resin. The resin used for the photothermal converting layer is not particularly limited and may be appropriately selected from those known in the art, so long as the resin can hold the inorganic material or the organic material. Thermoplastic resins or thermosetting resins are preferable. Those described for a binder resin used in the recording layer can be suitably used. Among them, resins curable by heat, UV rays, or electron beams are preferably used and thermal cross-linking resins using an isocyanate-based compound as a cross-linking agent are particularly preferable, in order to improve durability to repetitive use.

—First and Second Oxygen Barrier Layers—

First and second oxygen barrier layers are preferably disposed on the top and bottom of the thermoreversible recording layer for the purpose of preventing oxygen from entering the thermoreversible recording layer to prevent photodeterioration of a leuco dye in the first and second thermoreversible recording layers. The first oxygen barrier layer may be disposed on a surface of a support on which surface the first thermoreversible recording layer is not disposed, and the second oxygen barrier layer may be disposed on the thermoreversible recording layer. Alternatively, the first oxygen barrier layer may be disposed between the support and the thermoreversible recording layer, and the second oxygen barrier layer may be disposed on the thermoreversible recording layer.

—Protective Layer—

The thermoreversible recording medium preferably includes a protective layer on the thermoreversible recording layer for the purpose of protecting the thermoreversible recording layer. The protective layer is not particularly limited and may be appropriately selected depending on the intended purpose. The protective layer may be disposed on one or more layers. The protective layer is preferably disposed on the exposed outermost surface.

—UV Ray Absorbing Layer—

In the present invention, a UV ray absorbing layer is preferably disposed on a side of the thermoreversible recording layer opposite to a side where the support is disposed. This is for the purpose of preventing erasion failure, the erasion failure arising as a result of coloring and photodeterioration of a leuco dye, which is included in the thermoreversible recording layer, caused by UV rays. The UV ray absorbing layer can improve light resistance of the recording medium. A thickness of the UV ray absorbing layer is appropriately selected so that the UV ray absorbing layer absorbs UV rays of 390 nm or shorter.

—Intermediate Layer—

In the present invention, an intermediate layer is preferably disposed between the thermoreversible recording layer and the protective layer. This is for the purposes of improving adhesion between the thermoreversible recording layer and the protective layer, preventing deterioration of the thermoreversible recording layer due to the coating of the protective layer, and preventing additives included in the protective layer from migrating into the thermoreversible recording layer. The intermediate layer can improve a preservation property of a colored image.

—Under Layer—

In the present invention, an under layer may be disposed between the thermoreversible recording layer and the support. This is for the purpose of effectively utilizing applied heat to increase sensitivity, improving adhesion between the support and the thermoreversible recording layer, or preventing permeation of the recording layer material into the support.

The under layer includes at least hollow particles, may include a binder resin, and, if necessary, may further include other components.

—Back Layer—

In the present invention, a back layer may be disposed on a side of the support opposite to a side where the thermoreversible recording layer is disposed. This is for the purposes of preventing curling or charging of the thermoreversible recording medium, and improving a conveyance property of the thermoreversible recording medium.

The back layer includes at least a binder resin, and, if necessary, further includes other components such as fillers, conductive fillers, lubricants, and color pigments.

—Adhesive Layer or Bonding Agent Layer—

In the present invention, an adhesive layer or a bonding agent layer may be disposed on a surface of the support opposite to a surface where the thermoreversible recording layer is formed, and thus the thermoreversible recording material may be used as a thermoreversible label. A material of the adhesive layer or the bonding agent layer may be those commonly used.

Figure 5:
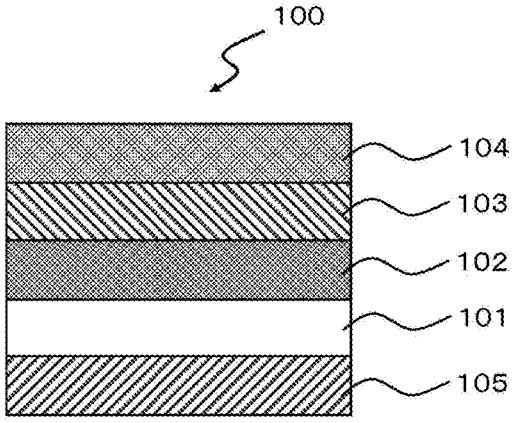
FIG. 5 is a schematic, cross-sectional view illustrating one exemplary layer structure of a thermoreversible recording medium.

One exemplary layer structure of the thermoreversible recording medium 100 is illustrated in FIG. 5. That is, in this aspect, the thermoreversible recording medium 100 includes a support 101, a thermoreversible recording layer 102 including a photothermal converting material, a first oxygen barrier layer 103, and a UV ray absorbing layer 104. The thermoreversible recording layer 102, the first oxygen barrier layer 103, and the UV ray absorbing layer 104 are disposed in this order on the support. The thermoreversible recording medium 100 further includes a second oxygen barrier layer 105 disposed on a surface of the support 101 on which surface the thermoreversible recording layer is not disposed. Note that, a protective layer may be formed on the outermost surface layer, although the protective layer is not illustrated in the drawing.

<Mechanism of Image Recording and Image Erasing>

A mechanism of the image recording and the image erasing is an aspect where a color tone reversibly changes by heat. The aspect uses a leuco dye and a reversible color developer (hereinafter may be referred as a "color developer"). In this aspect, the color tone reversibly changes between a transparent state and a colored state by heat.

Figure 4A:
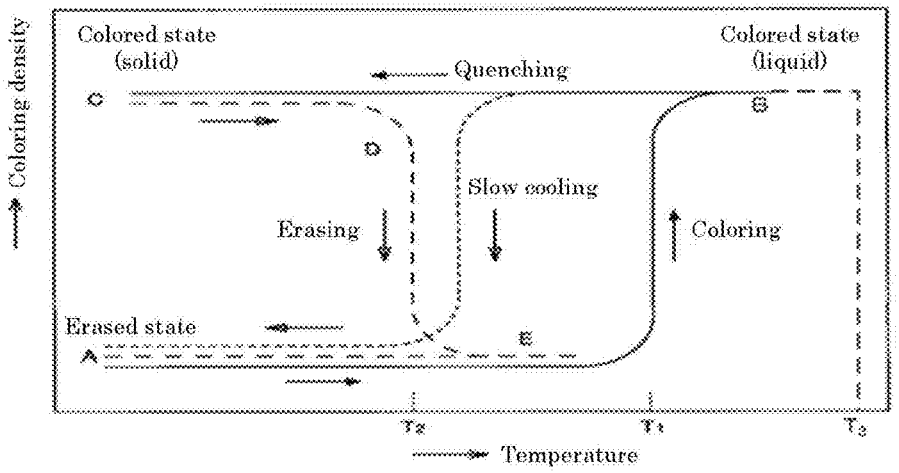
FIG. 4A is a graph illustrating a coloring-erasing property of a thermoreversible recording medium.
Figure 4B:
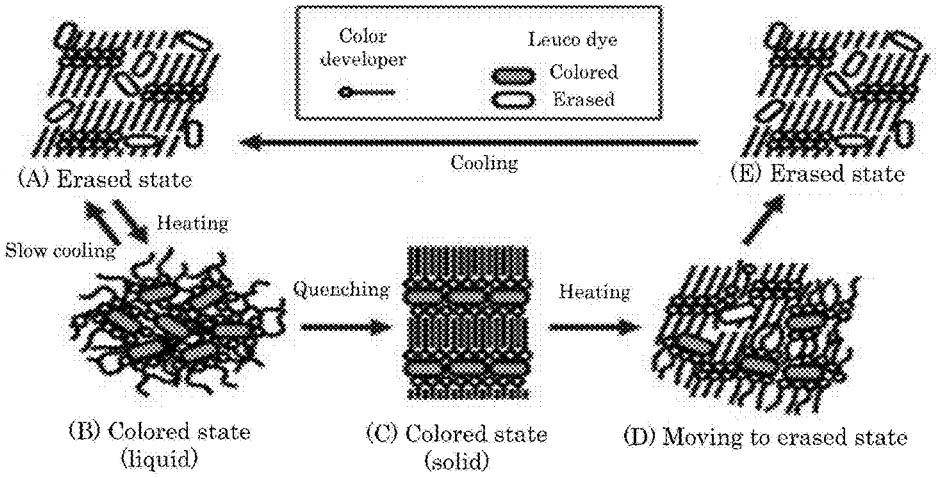
FIG. 4B is a schematic, explanatory view illustrating a mechanism of a coloring-erasing change of a thermoreversible recording medium.

FIG. 4A illustrates one exemplary temperature-color density variation curve of a thermoreversible recording medium including a thermoreversible recording layer in which the leuco dye and the color developer are included in the resin. FIG. 4B illustrates a coloring-erasing mechanism of the thermoreversible recording medium which reversibly changes between a transparent state and a colored state by heat.

Firstly, when the recording layer initially in the erased state (A) is heated, the leuco dye and the color developer are melt-mixed at the melting temperature $T_1$ to color. As a result, the recording layer turns into the melt-colored state (B). When the recording layer in the melt-colored state (B) is quenched, the recording layer can be cooled to room temperature with being maintained in the colored state. Thus, the recording layer turns into the colored state (C) where the colored state is stabilized and fixed. Whether or not this colored state is obtained depends on a cooling speed from the melted state. When the recording layer is slowly cooled, the color is erased in the process of cooling and thus the recording layer turns into the erased state (A) that is identical to the initial state or into the state where the color has a relatively lower density than the colored state (C) obtained by quenching. When the recording layer in the colored state (C) is heated again, on the other hand, the color is erased at the temperature $T_2$ lower than the coloring temperature (from D to E). When the recording layer in this state is cooled, the recording layer turns back to the erased state (A) that is identical to the initial state.

The colored state (C) obtained by quenching from the melted state is a state where the leuco dye and the color developer are mixed in a manner that molecules of the leuco dye and the color developer can undergo a contact reaction with each other, and the leuco dye and the color developer are often in a solid state. In this state, a melt mixture (a colored mixture) of the leuco dye and the color developer is crystallized to maintain the color. It is considered that the color is stabilized by formation of the crystallized melt mixture. On the other hand, the erased state is a state where the leuco dye and the color developer are phase-separated. In this case, molecules of at least one of the leuco dye and the color developer are assembled together to form a domain or are crystallized. It is considered that the leuco dye and the color developer are separated from each other through aggregation or crystallization to be stabilized. In many cases, more complete erasion is realized when the leuco dye and the color developer are phase-separated and the color developer is crystallized.

Note that, aggregated structure of the leuco dye and the color developer is changed to cause crystallization of the color developer or phase-separation at $T_2$ both in the erasion realized by slowly cooling from the melted state and the erasion realized by heating from the colored state, as illustrated in FIG. 4A.

In FIG. 4A, moreover, when the recording layer is repeatedly heated to the temperature $T_3$ that is equal to or higher than the melting temperature $T_1$, erasion failure may occur, that is, the erasion cannot be performed even after the recording layer is heated to the erasion temperature. It is assumed that this is because the color developer is thermally decomposed. As a result, the color developer is difficult to aggregate or crystallize and thus to separate from the leuco dye. In order to prevent deterioration of the thermoreversible recording medium due to repetitive use, a difference between the melting temperature $T_1$ and the temperature $T_3$ illustrated in FIG. 4A is made small when the thermoreversible recording medium is heated. Thus, the thermoreversible recording medium can be prevented from deteriorating even after repetitive use.

The conveyor line system of the present invention can prevent deterioration in visibility or machine readability of the image part of the conveying container, the deterioration arising as a result of irradiation of the image part of the conveying container with laser light. Therefore, the conveyor line system of the present invention is suitably used, for example, for physical distribution management systems, delivery management systems, storage management systems, or process management systems in factories.

(Conveying Container)

A conveying container of the present invention includes a recording part in which image recording is performed by irradiation with laser light and an image part in which a displayed image has been drawn. The conveying container is repeatedly used.

A formula below is satisfied at a wavelength of the laser light emitted to the recording part during image recording: $A+30>B$ where A denotes an absorbance of the recording part and B denotes an absorbance of the image part of the conveying container.

The recording part is preferably the thermoreversible recording medium because an image can be recorded and erased repeatedly.

A shape, a size, a material, and a structure of the conveying container are not particularly limited and may be appropriately selected depending on the intended purpose.

The material of the conveying container is not particularly limited and may be appropriately selected depending on the intended purpose. Examples of the material include wood, paper, cardboard, resins, metals, and glass. Among them, resins are particularly preferable from the viewpoints of formability, durability, and light weight.

The resins are not particularly limited and may be appropriately selected depending on the intended purpose. Examples of the resins include polyethylene resins, polypropylene resins, vinyl chloride resins, polystyrene resins, AS resins, ABS resins, polyethylene terephthalate resins, acrylic resins, polyvinyl alcohol resins, vinylidene chloride resins, polycarbonate resins, polyamide resins, acetal resins, polybutylene terephthalate resins, fluororesins, phenol resins, melamine resins, urea resins, polyurethane resins, epoxy resins, and unsaturated polyester resins. These may be used alone or in combination. Among them, polypropylene resins and polyethylene terephthalate resins are preferable from the viewpoints of chemical resistance, mechanical strength, and heat resistance.

Specific examples of the conveying container include plastic containers and cardboard boxes.

In the case where the material for the conveying container is transparent, a colorant is preferably included. With a transparent conveying container without the colorant, contents of the conveying container may be seen from outside. There is a case where the transparent conveying container is desired. However, if the contents of the conveying container can be seen from outside, invasion of privacy or leak of information may be concerned depending on the contents.

—Colorant—

The colorant includes pigments and dyes. Among them, pigments having excellent weather resistance are preferable in view of repetitive use of the conveying container in the conveyor line system.

The pigments are not particularly limited and may be appropriately selected depending on the intended purpose. Examples of the pigments include phthalocyanine-based pigments, isoindolinone-based pigments, isoindoline-based pigments, quinacridone-based pigments, perylene-based pigments, azo-pigments, anthraquinone-based pigments, titanium oxide, cobalt blue, ultramarine, carbon black, iron oxide, cadmium yellow, cadmium red, chrome yellow, and chromium oxide. These may be used alone or in combination.

In the case of the conveying container formed of a resin, for example, the colorant may be kneaded with the resin at a time when the conveying container is shaped. Moreover, an amount of the colorant included in the conveying container may be appropriately selected depending on the intended purpose, but the colorant may be added in an amount in which contents of the conveying container cannot be seen from outside.

A shaping method of the conveying container formed of the resin is not particularly limited and may be appropriately selected depending on the intended purpose. Examples of the method include extrusion molding, blow molding, vacuum molding, calendar molding, and injection molding.

A surface of the conveying container includes an image part in which a displayed image is drawn and a non-image part in which a displayed image is not drawn.

A material of the displayed image on the image part is not particularly limited and may be appropriately selected depending on the intended purpose. Examples of the material include colorants. Inclusion of the colorants makes it easy to visually identify contents of the image.

The colorants include pigments and dyes. The colorants may be appropriately selected depending on the intended purpose, but are preferably pigments having excellent weather resistance in view of repetitive use of the conveying container in the conveyor line system. Among the pigments, inorganic pigments having excellent weather resistance are particularly preferable. The inorganic pigments may be appropriately selected depending on the intended purpose. Examples of the inorganic pigments include white pigments such as zinc flower, white lead, lithopone, titanium dioxide, precipitated barium sulfate, and baryta powder; red pigments such as red lead and red iron oxide; yellow pigments such as chrome yellow and zinc yellow; blue pigments such as ultramarine blue and prussian blue; and black pigments such as carbon black.

Examples of the displayed image include company logos, alarm displays, instructions, and barcode images. Formation of the displayed image in the conveying container can improve a handling property and safety of the conveying container.

A method for forming the displayed image on a surface of the conveying container is not particularly limited and may be appropriately selected depending on the intended purpose. Examples of the method include electrophotographies, ink jet methods, and printing methods. Among them, printing methods are preferable.

The printing methods are not particularly limited and may be appropriately selected depending on the intended purpose. Examples of the printing methods include screen printing methods, flexographic printing methods, and pad printing methods. Among them, screen printing methods are particularly preferable because various kinds of images can be printed on various kinds of conveying containers having various shapes.

Note that, a surface of the conveying container may be coated with a surface protecting agent for the purpose of preventing scratches on the surface, or a polishing agent, a matting agent, an antifouling agent, or an anti-rust agent for the purpose of improving external appearance. The surface of the conveying container may be processed with surface texturing for the purpose of improving releasability of a label.

EXAMPLES

The present invention will now be described, but the present invention is not limited to Examples in any way.

RICOH REWRITABLE LASER MEDIA (RLM-100L, available from Ricoh Company Limited) was irradiated with laser light having a center wavelength of 980 nm using RICOH REWRITABLE LASER MARKER (LDM-200-110, available from Ricoh Company Limited) adjusted to have a laser output of 18.2 W, a scanning speed of 3,000 mm/s, and an emission distance of 150 mm. Thus, a solid square image having a height of 8.0 mm and a width of 8.0 mm was drawn. Note that, the RICOH REWRITABLE LASER MEDIA (RLM-100L, available from Ricoh Company Limited) was a thermoreversible recording medium including a thermoreversible recording layer including a photothermal converting material.

Subsequently, the RICOH REWRITABLE LASER MEDIA (RLM-100L, available from Ricoh Company Limited), which had been attached to a conveying container as a recording part, was irradiated with laser light having a center wavelength of 976 nm using RICOH REWRITABLE LASER ERASER (LDE-800-A, available from Ricoh Company Limited) adjusted to have a laser output of 71.4 W, a scanning speed of 45 mm/s, and an emission distance of 110 mm. Thus, the solid square image was erased.

Laser light irradiation was repeated 1,000 times under the aforementioned conditions. The laser light irradiation was counted as once when laser light irradiation by the RICOH REWRITABLE LASER MARKER (LDM-200-110, available from Ricoh Company Limited) and laser light irradiation by the RICOH REWRITABLE LASER ERASER (LDE-800-A, available from Ricoh Company Limited) were respectively performed once. As a result, recording and erasing of the image could be performed.

Example 1

A reflectance of RICOH REWRITABLE LASER MEDIA (RLM100L, available from Ricoh Company Limited) was measured by means of an integrating sphere spectrophotometer (SOLIDSPEC-3700, available from SHIMADZU CORPORATION). The result is presented in FIG. 6.

Figure 6:
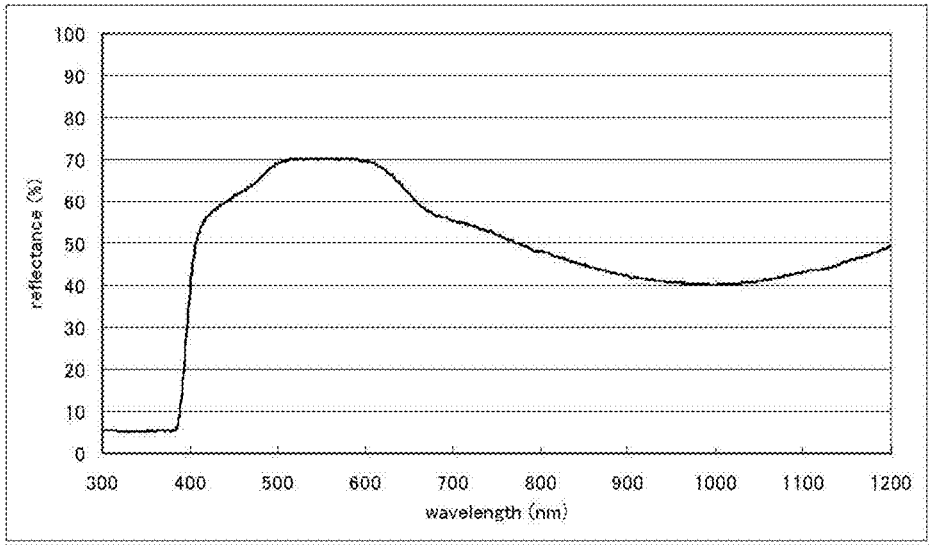
FIG. 6 is a graph illustrating a reflection property of a thermoreversible recording medium (RICOH REWRITABLE LASER MEDIA RLM-100L) used in Examples 1 to 9 and Comparative Examples 1 to 5.

From the result in FIG. 6, a reflectance at a wavelength of 980 nm (at the time of image recording) was determined as 40.5%. Thus, an absorbance at a wavelength of 980 nm (at the time of image recording) was determined as 59.5%.

Subsequently, a character "1" (line width: 10 mm, thickness: 10 μm) was formed by a screen printing method using a green ink (SSBTC791 GRASS GREEN, available from TOYO INK CO., LTD.) on a conveying container (cuboid, W: 40 cm, D: 30 cm, H: 30 cm) formed of a blue polypropylene (PP) resin plate (thickness: 2 mm, PP SHEET, available from SANKO Co., Ltd).

Figure 7:
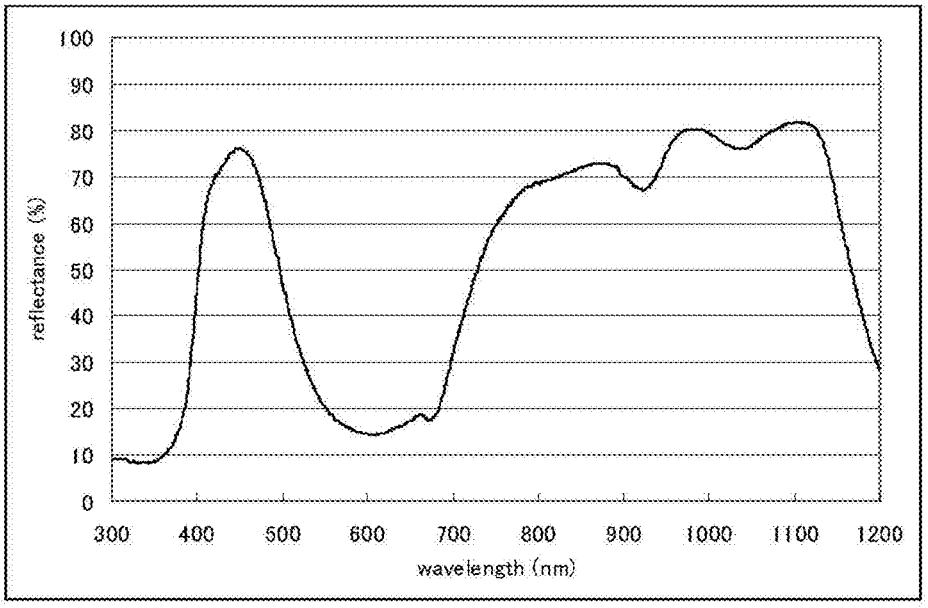
FIG. 7 is a graph illustrating a reflection property of a non-image part of a conveying container formed of a blue polypropylene (PP) resin plate.
Figure 8:
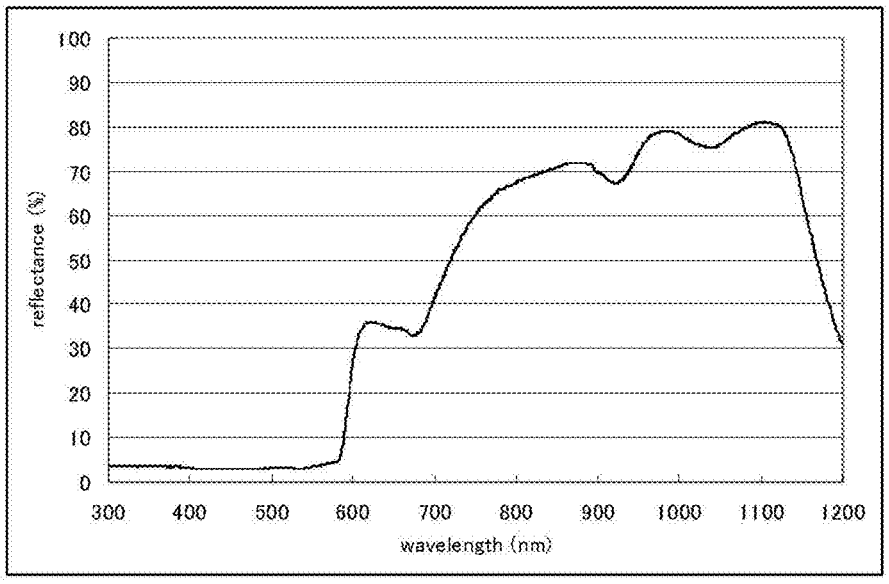
FIG. 8 is a graph illustrating a reflection property of an image part of a conveying container formed of a blue PP resin plate, in which a displayed image has been drawn with a green ink.

Reflectances of the resultant image part and the resultant non-image part of the conveying container were measured by means of an integrating sphere spectrophotometer (SOLIDSPEC-3700, available from SHIMADZU CORPORATION). The results are presented in FIGS. 7 and 8. From the results in FIGS. 7 and 8, the reflectance of the image part of the conveying container was determined as 69.4% and the reflectance of the non-image part of the conveying container was determined as 80.3%. Thus, an absorbance of the image part of the conveying container was determined as 13.6% according to a formula below. This absorbance was smaller than a value of the absorbance of the RICOH REWRITABLE LASER MEDIA RLM100L plus 30%.

$$\text{Absorbance of image part on conveying container } (\%) = 100 \times (1 - C/D)$$

where C (%) denotes a reflectance of the image part of the conveying container, in which a displayed image is drawn and D (%) denotes a reflectance of the non-image part of the conveying container, in which a displayed image is not drawn.

<Repeating Durability>

The image part of the conveying container was irradiated with laser light having a center wavelength of 980 nm using the RICOH REWRITABLE LASER MARKER (LDM-200-110, available from Ricoh Company Limited) adjusted to have a laser output of 18.2 W, a scanning speed of 3,000 mm/s, and an emission distance of 150 mm. Thus, a solid square image having a height of 8.0 mm and a width of 8.0 mm was drawn.

Subsequently, the image part (printed part) of the conveying container was irradiated with laser light having a center wavelength of 976 nm using the RICOH REWRITABLE LASER ERASER (LDE-800-A, available from Ricoh Company Limited) adjusted to have a laser output of 71.4 W, a scanning speed of 45 mm/s, and an emission distance of 110 mm.

Figure 18:
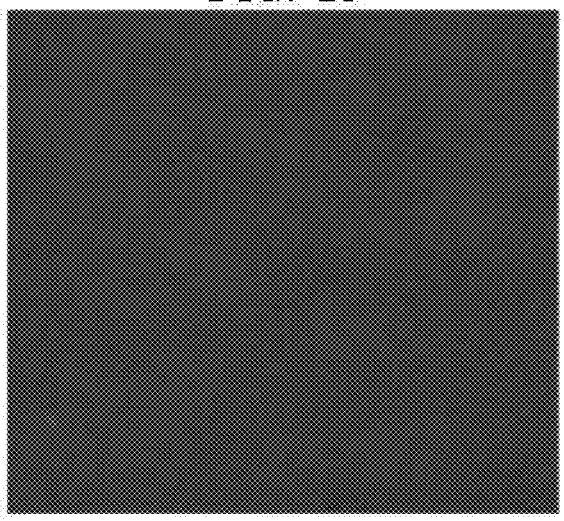
FIG. 18 is a scanned image of an ink image before laser irradiation in Example 1.
Figure 19:
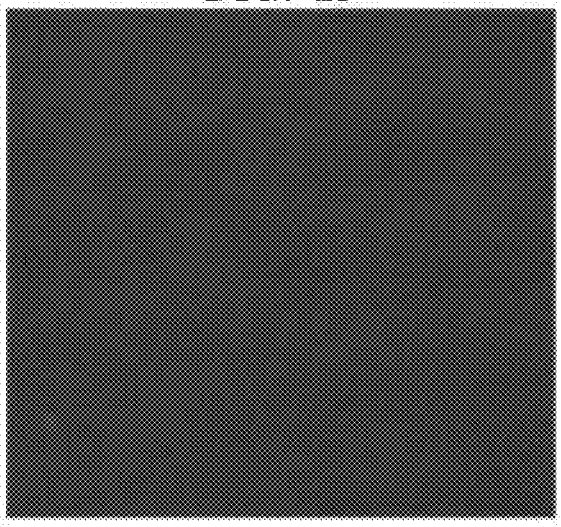
FIG. 19 is a scanned image of an ink image after laser irradiation in Example 1.

Laser light irradiation was repeated 10 times under the aforementioned conditions where the laser light irradiation was counted as once when laser light irradiation by the RICOH REWRITABLE LASER MARKER (LDM-200-110, available from Ricoh Company Limited) and laser light irradiation by the RICOH REWRITABLE LASER ERASER (LDE-800-A) were respectively performed once. As a result, the image part of the conveying container was found to have good visibility. Repeating durability was evaluated according to evaluation criteria described below. The results are presented in Tables 1 and 2. FIG. 18 is a scanned image of an ink image before laser irradiation and FIG. 19 is a scanned image of an ink image after laser irradiation. From these results, the ink image after laser irradiation can be said to have image quality equivalent to the ink image before laser irradiation.

[Evaluation Criteria]

A: The image part of the conveying container was not visually discolored or was able to be read by a barcode scanner even after the laser light irradiation was repeated 10 times.

B: The image part of the conveying container was able to be visually read even after the laser light irradiation was repeated 10 times.

C: The image part of the conveying container was not able to be read visually or by a barcode scanner after the laser light irradiation was repeated 10 times or less.

Example 2

An absorbance was measured under the same conditions as in Example 1, except that a red ink (SSBTC193S RED, available from TOYO INK CO., LTD.) was used instead of the green ink (SSBTC791 GRASS GREEN).

Figure 9:
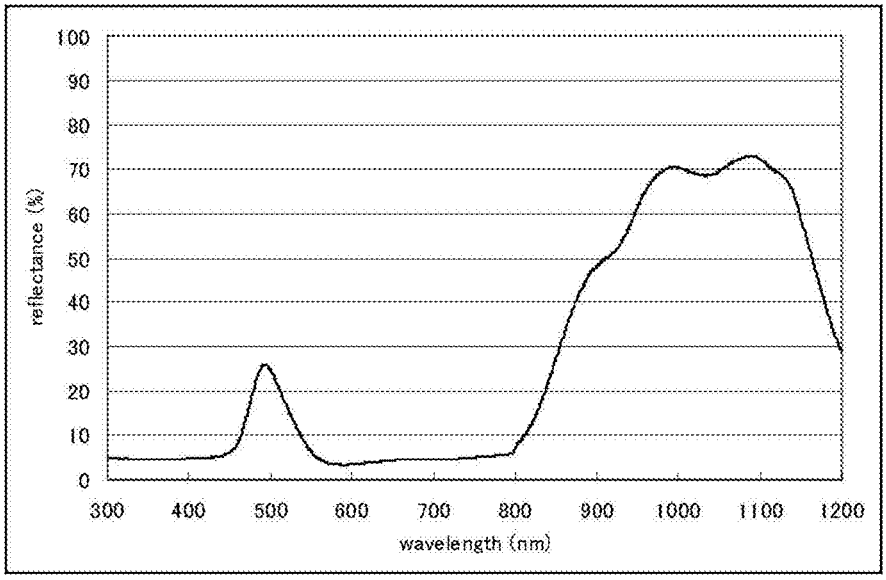
FIG. 9 is a graph illustrating a reflection property of an image part of a conveying container formed of a blue PP resin plate, in which a displayed image has been drawn with a red ink.

Reflectances of the image part and the non-image part of the conveying container were measured in the same manner as in Example 1. The results are presented in FIGS. 7 and 9. From the results in FIGS. 7 and 9, the reflectance of the image part was determined as 79.1% and the reflectance of the non-image part was determined as 80.3%. Thus, an absorbance of the image part of the conveying container was determined as 1.5% in the same manner as in Example 1. This absorbance was smaller than a value of the absorbance of the RICOH REWRITABLE LASER MEDIA RLM100L plus 30%.

Repeating durability after repeated laser light irradiation was evaluated in the same manner as in Example 1. As a result, the image part of the conveying container was found to have good visibility even after the laser light irradiation was repeated 10 times. The results are presented in Tables 1 and 2.

Example 3

An absorbance was measured under the same conditions as in Example 1, except that a mixture of 65 equivalents of the green ink (SSBTC791 GRASS GREEN, available from TOYO INK CO., LTD.) and 1 equivalent of a black ink (SSBTC911 INK BLACK, available from TOYO INK CO., LTD.) was used.

Figure 10:
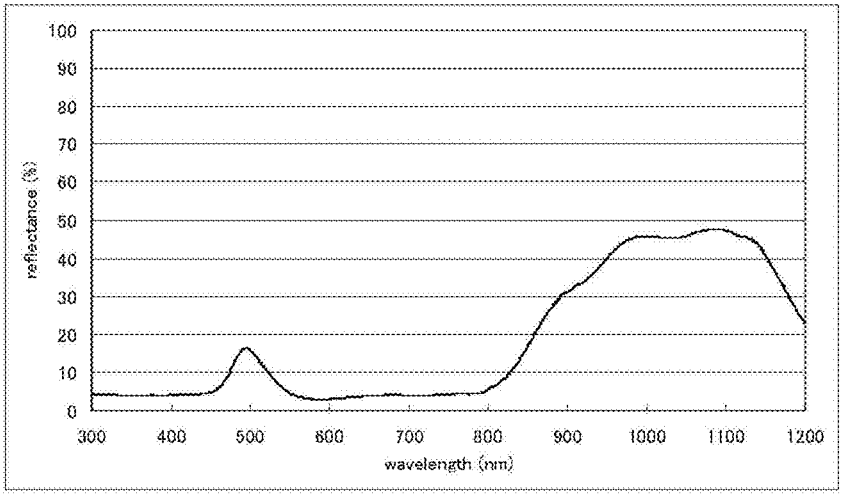
FIG. 10 is a graph illustrating a reflection property of an image part of a conveying container formed of a blue PP resin plate, in which a displayed image has been drawn with a black ink.

Reflectances of the image part and the non-image part of the conveying container were measured in the same manner as in Example 1. The results are presented in FIGS. 7 and 10. From the results in FIGS. 7 and 10, the reflectance of the image part was determined as 45.0% and the reflectance of the non-image part was determined as 80.3%. Thus, an absorbance of the image part of the conveying container was determined as 44.0% in the same manner as in Example 1. This absorbance was smaller than a value of the absorbance of the RICOH REWRITABLE LASER MEDIA RLM IDOL plus 30%.

Repeating durability after repeated laser light irradiation was evaluated in the same manner as in Example 1. As a result, the image part of the conveying container was found to have good visibility even after the laser light irradiation was repeated 10 times. The results are presented in Tables 1 and 2.

Example 4

An absorbance was measured under the same conditions as in Example 1, except that a mixture of 25 equivalents of the green ink (SSBTC791 GRASS GREEN, available from TOYO INK CO., LTD.) and 1 equivalent of the black ink (SSBTC911 INK BLACK, available from TOYO INK CO., LTD.) was used instead of the green ink (SSBTC791 GRASS GREEN).

Figure 11:
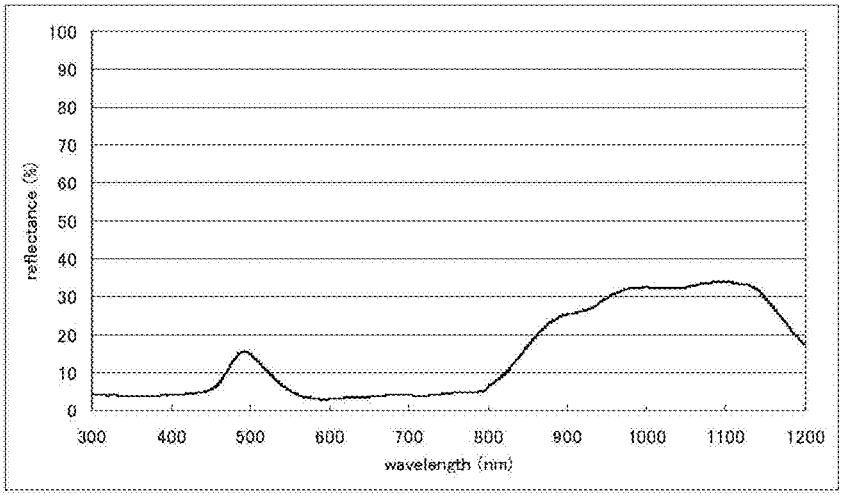
FIG. 11 is a graph illustrating a reflection property of an image part of a conveying container formed of a blue PP resin plate, in which a displayed image has been drawn with a mixed ink of a green ink and a black ink.

Reflectances of the image part and the non-image part of the conveying container were measured in the same manner as in Example 1. The results are presented in FIGS. 7 and 11. From the results in FIGS. 7 and 11, the reflectance of the image part was determined as 32.1% and the reflectance of the non-image part was determined as 80.3%. Thus, an absorbance of the image part of the conveying container was determined as 60.0% in the same manner as in Example 1. This absorbance was smaller than a value of the absorbance of the RICOH REWRITABLE LASER MEDIA RLM100L plus 30%.

Repeating durability after repeated laser light irradiation was evaluated in the same manner as in Example 1. As a result, the image part of the conveying container was found to have good visibility even after the laser light irradiation was repeated 10 times. The results are presented in Tables 1 and 2.

Example 5

An absorbance was measured under the same conditions as in Example 1, except that a mixture of 10 equivalents of the green ink (SSBTC791 GRASS GREEN, available from TOYO INK CO., LTD.) and 1 equivalent of the black ink (SSBTC911 INK BLACK, available from TOYO INK CO., LTD.) was used instead of the green ink (SSBTC791 GRASS GREEN).

Figure 12:
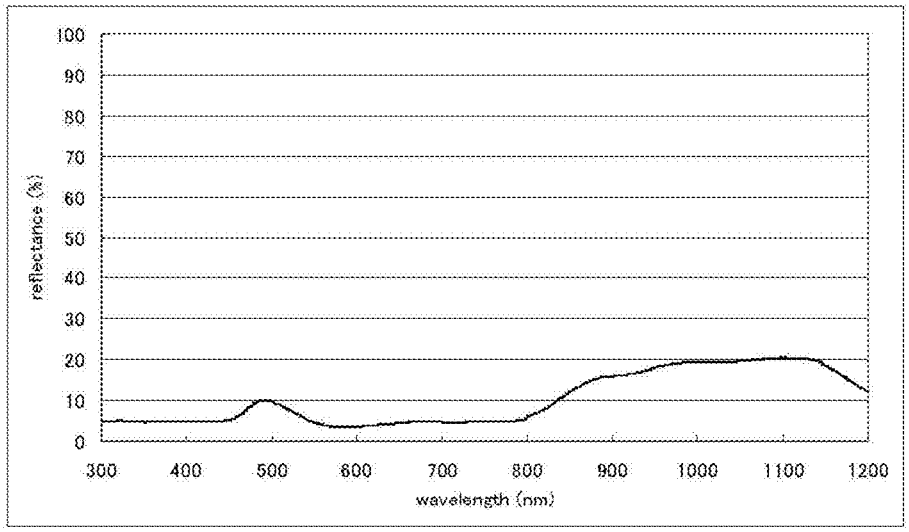
FIG. 12 is a graph illustrating a reflection property of an image part of a conveying container formed of a blue PP resin plate, in which a displayed image has been drawn with a mixed ink of a green ink and a black ink.

Reflectances of the image part and the non-image part of the conveying container were measured in the same manner as in Example 1. The results are presented in FIGS. 7 and 12. From the results in FIGS. 7 and 12, the reflectance of the image part was determined as 15.6% and the reflectance of the non-image part was determined as 80.3%. Thus, an absorbance of the image part of the conveying container was determined as 80.6% in the same manner as in Example 1. This absorbance was smaller than a value of the absorbance of the RICOH REWRITABLE LASER MEDIA RLM100L plus 30%.

Repeating durability after repeated laser light irradiation was evaluated in the same manner as in Example 1. As a result, the image part of the conveying container was found to have good visibility even after the laser light irradiation was repeated 10 times. The results are presented in Tables 1 and 2.

Comparative Example 1

An absorbance was measured under the same conditions as in Example 1, except that the black ink (SSBTC911 INK BLACK, available from TOYO INK CO., LTD.) was used instead of the green ink (SSBTC791 GRASS GREEN).

Figure 13:
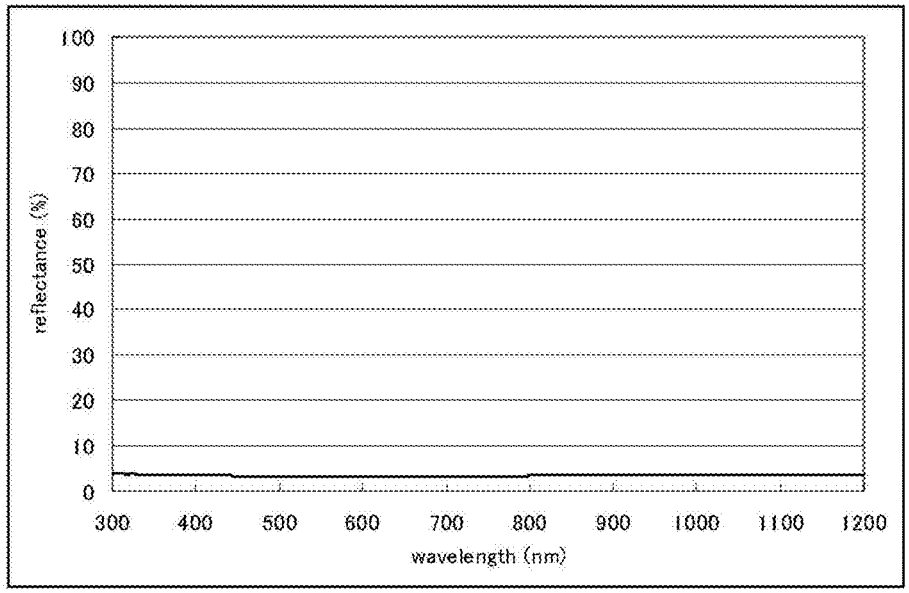
FIG. 13 is a graph illustrating a reflection property of an image part of a conveying container formed of a blue PP resin plate, in which a displayed image has been drawn with a black ink.

Reflectances of the image part and the non-image part of the conveying container were measured in the same manner as in Example 1. The results are presented in FIGS. 7 and 13. From the results in FIGS. 7 and 13, the reflectance of the image part was determined as 3.6% and the reflectance of the non-image part was determined as 80.3%. Thus, an absorbance of the image part of the conveying container was determined as 95.5% in the same manner as in Example 1. This absorbance was larger than a value of the absorbance of the RICOH REWRITABLE LASER MEDIA RLM100L plus 30%.

Repeating durability after repeated laser light irradiation was evaluated in the same manner as in Example 1. As a result, the image part of the conveying container was blurred to deteriorate in visibility after the laser light irradiation was repeated 3 times or more. The results are presented in Tables 1 and 2.

Example 6

An absorbance was measured under the same conditions as in Example 1, except that a conveying container was formed of a white polyethylene terephthalate (PET) resin plate (thickness: 0.1 mm, LUMIRROR E28G, available from Toray Industries, Inc.) instead of the blue PP resin plate (thickness: 2 mm).

Figure 14:
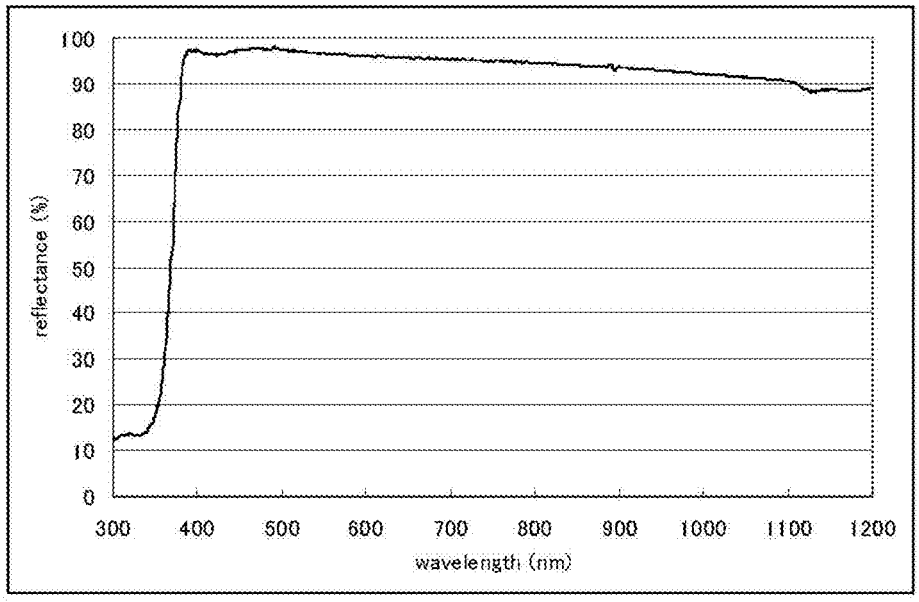
FIG. 14 is a graph illustrating a reflection property of a non-image part of a conveying container formed of a white polyethylene terephthalate (PET) resin plate.
Figure 15:
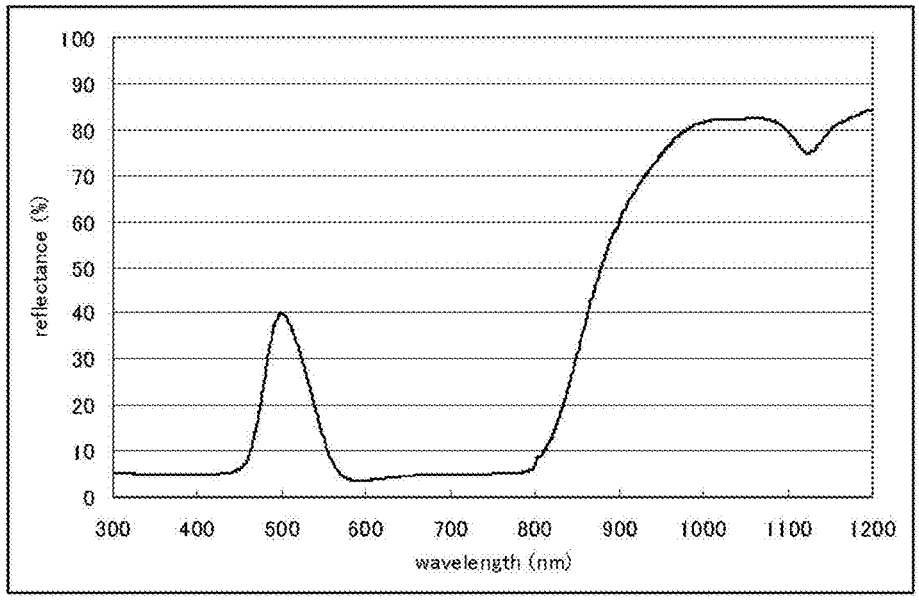
FIG. 15 is a graph illustrating a reflection property of an image part of a conveying container formed of a white PET resin plate, in which a displayed image has been drawn with a green ink.

Reflectances of the image part and the non-image part of the conveying container were measured in the same manner as in Example 1. The results are presented in FIGS. 14 and 15. From the results in FIGS. 14 and 15, the reflectance of the image part was determined as 80.0% and the reflectance of the non-image part was determined as 92.5%. Thus, an absorbance of the image part of the conveying container was determined as 13.5% in the same manner as in Example 1. This absorbance was smaller than a value of the absorbance of the RICOH REWRITABLE LASER MEDIA RLM100L plus 30%.

Repeating durability after repeated laser light irradiation was evaluated in the same manner as in Example 1. As a result, the image part of the conveying container was found to have good visibility even after the laser light irradiation was repeated 10 times. The results are presented in Tables 1 and 2.

Comparative Example 2

An absorbance was measured under the same conditions as in Example 6, except that the black ink (SSBTC911 INK BLACK, available from TOYO INK CO., LTD.) was used instead of the green ink (SSBTC791 GRASS GREEN).

Figure 16:
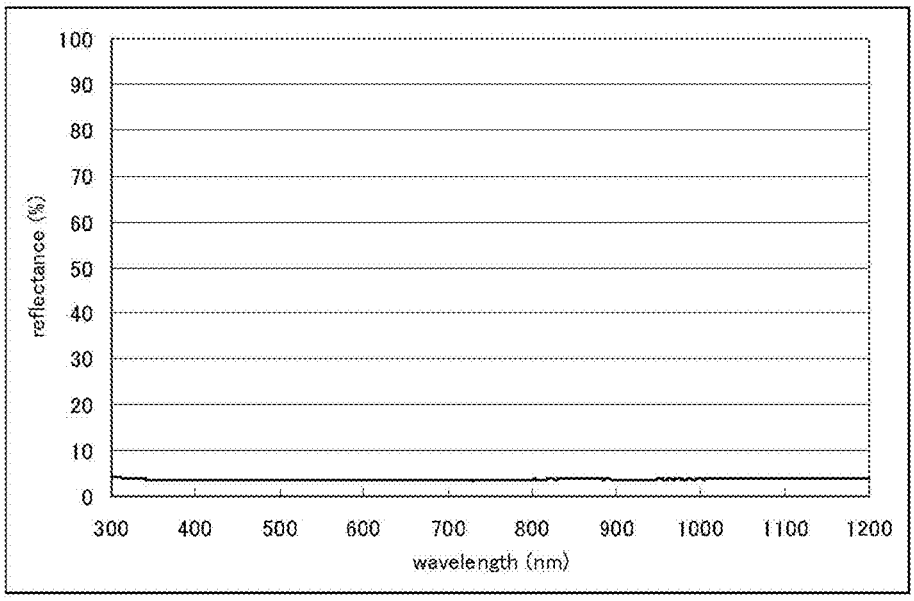
FIG. 16 is a graph illustrating a reflection property of an image part of a conveying container formed of a white PET resin plate, in which a displayed image has been drawn with a black ink.

Reflectances of the image part and the non-image part of the conveying container were measured in the same manner as in Example 1. The results are presented in FIGS. 14 and 16. From the results in FIGS. 14 and 16, the reflectance of the image part was determined as 3.7% and the reflectance of the non-image part was determined as 92.5%. Thus, an absorbance of the image part of the conveying container was determined as 96.0% in the same manner as in Example 1. This absorbance was larger than a value of the absorbance of the RICOH REWRITABLE LASER MEDIA RLM100L plus 30%.

Figure 20:
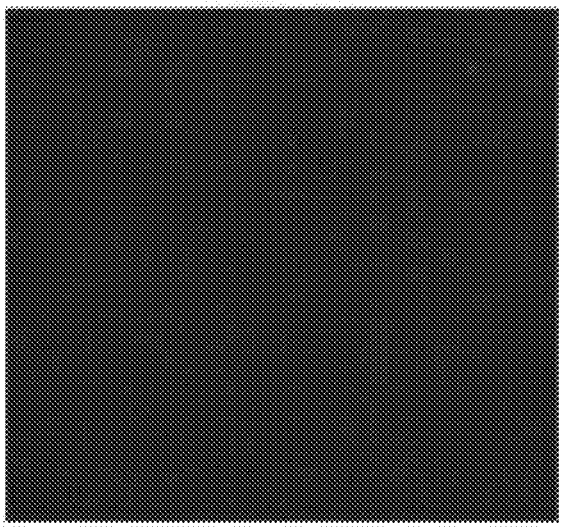
FIG. 20 is a scanned image of an ink image before laser irradiation in Comparative Example 2.
Figure 21:
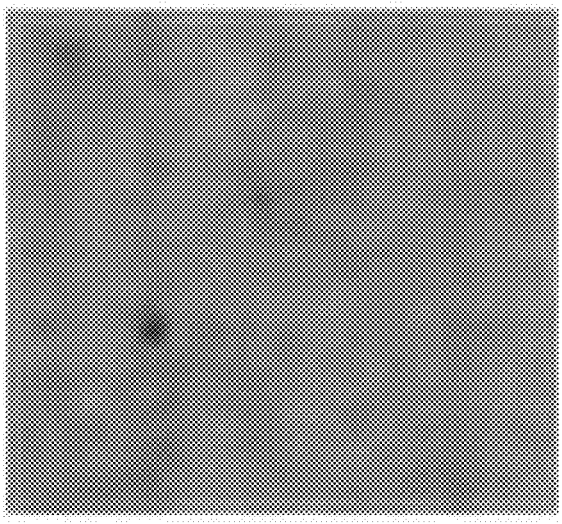
FIG. 21 is a scanned image of an ink image after laser irradiation in Comparative Example 2.

Repeating durability after repeated laser light irradiation was evaluated in the same manner as in Example 1. As a result, the image part of the conveying container was blurred to deteriorate in visibility after the laser light irradiation was repeated 3 times or more. The results are presented in Tables 1 and 2. FIG. 20 is a scanned image of an ink image before laser irradiation and FIG. 21 is a scanned image of an ink image after laser irradiation. From these results, it has been found that the ink image after laser irradiation cannot be recognized due to scrape of the ink.

Example 7

An absorbance was measured under the same conditions as in Example 1, except that a character "0" (line width: 1 mm) was formed as the displayed image instead of the character "1" (line width: 10 mm).

Reflectances of the image part and the non-image part of the conveying container were measured in the same manner as in Example 1. The results are presented in FIGS. 7 and 8. From the results in FIGS. 7 and 8, the reflectance of the image part was determined as 69.4% and the reflectance of the non-image part was determined as 80.3%. Thus, an absorbance of the image part of the conveying container was determined as 13.6% in the same manner as in Example 1. This absorbance was smaller than a value of the absorbance of the RICOH REWRITABLE LASER MEDIA RLM100L plus 30%.

Repeating durability after repeated laser light irradiation was evaluated in the same manner as in Example 1. As a result, the image part of the conveying container was found to have good visibility even after the laser light irradiation was repeated 10 times. The results are presented in Tables 1 and 2.

Comparative Example 3

An absorbance was measured under the same conditions as in Example 7, except that the black ink (SSBTC911 INK BLACK, available from TOYO INK CO., LTD.) was used instead of the green ink (SSBTC791 GRASS GREEN).

Reflectances of the image part and the non-image part of the conveying container were measured in the same manner as in Example 1. The results are presented in FIGS. 7 and 13. From the results in FIGS. 7 and 13, the reflectance of the image part was determined as 3.6% and the reflectance of the non-image part was determined as 80.3%. Thus, an absorbance of the image part of the conveying container was determined as 95.5% in the same manner as in Example 1. This absorbance was larger than a value of the absorbance of the RICOH REWRITABLE LASER MEDIA RLM100L plus 30%.

Repeating durability after repeated laser light irradiation was evaluated in the same manner as in Example 1. As a result, the image part of the conveying container was blurred to deteriorate in visibility after the laser light irradiation was repeated 3 times or more. The results are presented in Tables 1 and 2.

Example 8

An absorbance was measured under the same conditions as in Example 1, except that a character "0" (line width: 10 mm) was formed as the displayed image instead of the character "1" (line width: 10 mm).

Reflectances of the image part and the non-image part of the conveying container were measured in the same manner as in Example 1. The results are presented in FIGS. 7 and 8. From the results in FIGS. 7 and 8, the reflectance of the image part was determined as 69.4% and the reflectance of the non-image part was determined as 80.3%. Thus, an absorbance of the image part of the conveying container was determined as 13.6% in the same manner as in Example 1. This absorbance was smaller than a value of the absorbance of the RICOH REWRITABLE LASER MEDIA RLM100L plus 30%.

Repeating durability after repeated laser light irradiation was evaluated in the same manner as in Example 1, except that the image part of the conveying container was irradiated with laser light to draw a line having a height of 8.0 mm and a width of 0.25 mm instead of the solid square image having a height of 8.0 mm and a width of 8.0 mm. As a result, the image part of the conveying container was found to have good visibility even after the laser light irradiation was repeated 10 times. The results are presented in Tables 1 and 2.

Comparative Example 4

An absorbance was measured under the same conditions as in Example 8, except that the black ink (SSBTC911 INK BLACK, available from TOYO INK CO., LTD.) was used instead of the green ink (SSBTC791 GRASS GREEN).

Reflectances of the image part and the non-image part of the conveying container were measured in the same manner as in Example 1. The results are presented in FIGS. 7 and 13. From the results in FIGS. 7 and 13, the reflectance of the image part was determined as 3.6% and the reflectance of the non-image part was determined as 80.3%. Thus, an absorbance of the image part of the conveying container was determined as 95.5% in the same manner as in Example 1. This absorbance was larger than a value of the absorbance of the RICOH REWRITABLE LASER MEDIA RLM100L plus 30%.

Repeating durability after repeated laser light irradiation was evaluated in the same manner as in Example 1. As a result, the image part of the conveying container was blurred to deteriorate in visibility after the laser light irradiation was repeated 5 times or more. The results are presented in Tables 1 and 2.

Example 9

An absorbance was measured under the same conditions as in Example 1, except that a barcode image (maximum line width: 1 mm) was formed as the displayed image instead of the character "1" (line width: 10 mm).

Reflectances of the image part and the non-image part of the conveying container were measured in the same manner as in Example 1. The results are presented in FIGS. 7 and 8. From the results in FIGS. 7 and 8, the reflectance of the image part was determined as 69.4% and the reflectance of the non-image part was determined as 80.3%. Thus, an absorbance of the image part of the conveying container was determined as 13.6% in the same manner as in Example 1. This absorbance was smaller than a value of the absorbance of the RICOH REWRITABLE LASER MEDIA RLM100L plus 30%.

After the laser light irradiation was repeated, the barcode was read by a barcode scanner (BL-1301HA, available from KEYENCE CORPORATION). As a result, the barcode was able to be read even after the laser light irradiation was repeated 10 times. The results are presented in Tables 1 and 2.

Comparative Example 5

An absorbance was measured under the same conditions as in Example 9, except that the black ink (SSBTC911 INK BLACK, available from TOYO INK CO., LTD.) was used instead of the green ink (SSBTC791 GRASS GREEN).

Reflectances of the image part and the non-image part of the conveying container were measured in the same manner as in Example 1. The results are presented in FIGS. 7 and 13. From the results in FIGS. 7 and 13, the reflectance of the image part was determined as 3.6% and the reflectance of the non-image part was determined as 80.3%. Thus, an absorbance of the image part of the conveying container was determined as 95.5% in the same manner as in Example 1. This absorbance was larger than a value of the absorbance of the RICOH REWRITABLE LASER MEDIA RLM100L plus 30%.

After the laser light irradiation was repeated, the barcode was read by the barcode scanner (BL-1301HA, available from KEYENCE CORPORATION). As a result, the barcode was not able to be read after the laser light irradiation was repeated 3 times or more.

Example 10

<Production of Thermosensitive Recording Medium>

A thermoreversible recording medium, a color tone of which reversibly changes, was produced in the following manner.

—Thermosensitive Recording Layer—

By means of a ball mill, 6 parts by mass of octadecylphosphonic acid serving as a color developer, 16 parts by mass of a 10% by mass polyvinyl acetoacetal solution (KS-1, available from Sekisui Chemical Co., Ltd.), 12 parts by mass of toluene, and 3 parts by mass of methyl ethyl ketone were ground and dispersed until an average particle diameter reached 0.3 μm. Then, 1.5 parts by mass of 2-anilino-3-methyl-6-diethylaminofluoran serving as a leuco dye and 0.9 parts by mass of a 1.85% by mass $LaB_6$ dispersion solution (KHF-7A, available from Sumitomo Metal Mining Co., Ltd.) serving as a photothermal converting material were added to the resultant dispersion liquid. The resultant dispersion liquid was sufficiently stirred to prepare a thermosensitive recording layer coating liquid. Subsequently, the resultant thermosensitive recording layer coating liquid was coated onto a sheet of white polyester film (thickness: 125 μm, TETRON FILM U2L98W, available from Teijin DuPont Films Japan Limited) using a wire bar and heat-dried for 2 min at 60° C. to form a thermosensitive recording layer having a thickness of 10 μm.

—Protective Layer—

By means of a ball mill, 3 parts by mass of silica (P-832, available from Mizusawa Industrial Chemicals, Ltd.), 3 parts by mass of a 10% by mass polyvinyl acetoacetal solution (KS-1, available from Sekisui Chemical Co., Ltd.), and 14 parts by mass of methyl ethyl ketone were ground and dispersed until an average particle diameter reached about 0.3 μm. Then, 12 parts by mass of a 12.5% by mass silicone-modified polyvinyl butyral solution (SP-712, available from Dainichiseika Color & Chemicals Mfg Co., Ltd.) and 24 parts by mass of methyl ethyl ketone were added to the resultant dispersion liquid. The resultant dispersion liquid was sufficiently stirred to prepare a protective layer coating liquid. Subsequently, the protective layer coating liquid was coated onto the thermosensitive recording layer using a wire bar and heat-dried for 2 min at 60° C. to form a protective layer having a thickness of 1 μm.

—Bonding Agent Layer—

A bonding agent layer coating liquid was prepared by sufficiently stirring 4 parts by mass of an acrylic bonding agent (SK-DYNE 1720DT, available from Soken Chemical & Engineering Co., Ltd.), 1 part by mass of a curing agent (L-45E, available from Soken Chemical & Engineering Co., Ltd.), and 5 parts by mass of ethyl acetate. Subsequently, the resultant bonding agent layer coating liquid was coated using a wire bar onto a surface of the support opposite to a surface where the thermosensitive recording layer had been formed, and heat-dried for 2 min at 80° C. to form a bonding agent layer having a thickness of 20 μm. Thus, thermosensitive recording media of Example 10 and Comparative Example 5 were produced.

The thermosensitive recording medium of Example 10 was irradiated with laser light having a center wavelength of 980 nm using RICOH REWRITABLE LASER MARKER (LDM-200-110, available from Ricoh Company Limited) adjusted to have a laser output of 18.2 W, a scanning speed of 3,000 mm/s, and an emission distance of 150 mm. As a result, a solid square image having a height of 8.0 mm and a width of 8.0 mm was able to be drawn.

Laser light irradiation was repeated 10 times, where the laser light irradiation was counted as once when an image part of a conveying container was irradiated with laser light having a center wavelength of 980 nm using the RICOH REWRITABLE LASER MARKER (LDM-200-110, available from Ricoh Company Limited) adjusted to have a laser output of 18.2 W, a scanning speed of 3,000 mm/s, and an emission distance of 150 mm, to draw a solid square image having a height of 8.0 mm and a width of 8.0 mm. As a result, the image part of the conveying container was found to have good visibility. The result is presented in Table 2.

A reflectance of the thermosensitive recording medium of Example 10 was measured by means of an integrating sphere spectrophotometer (SOLIDSPEC-3700, available from SHIMADZU CORPORATION). The result is presented in FIG. 17.

Figure 17:
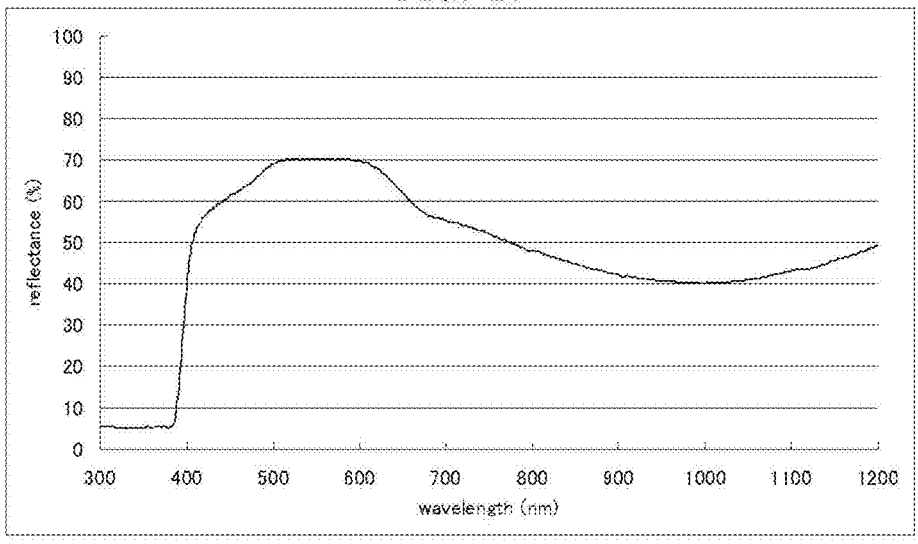
FIG. 17 is a graph illustrating a reflection property of a thermosensitive recording medium used in Example 10 and Comparative Example 6.

From the result in FIG. 17, a reflectance at a wavelength of 980 nm (at the time of image recording) was determined as 40.5%. Thus, an absorbance at a wavelength of 980 nm (at the time of image recording) was determined as 59.5%.

Reflectances of the image part and the non-image part of the conveying container were measured in the same manner as in Example 1. The results are presented in FIGS. 7 and 8. From the results in FIGS. 7 and 8, the reflectance of the image part was determined as 69.4% and the reflectance of the non-image part was determined as 80.3%. Thus, an absorbance of the image part of the conveying container was determined as 13.6% in the same manner as in Example 1. This absorbance was smaller than a value of the absorbance of the thermosensitive recording medium plus 30%. The results are presented in Tables 1 and 2.

Comparative Example 6

An absorbance was measured under the same conditions as in Example 10, except that the black ink (SSBTC911 INK BLACK, available from TOYO INK CO., LTD.) was used instead of the green ink (SSBTC791 GRASS GREEN).

Reflectances of the image part and the non-image part of the conveying container were measured in the same manner as in Example 10. The results are presented in FIGS. 7 and 13. From the results in FIGS. 7 and 13, the reflectance of the image part was determined as 3.6% and the reflectance of the non-image part was determined as 80.3%. Thus, an absorbance of the image part of the conveying container was determined as 95.5% in the same manner as in Example 10. This absorbance was larger than a value of the absorbance of the thermosensitive recording medium plus 30%.

Repeating durability after repeated laser light irradiation was evaluated in the same manner as in Example 10. As a result, the image part of the conveying container was blurred to deteriorate in visibility after the laser light irradiation was repeated 3 times or more. The results are presented in Tables 1 and 2.

TABLE 1

| | Conveying container | | | | Recording part | |
|---|---|---|---|---|---|---|
| | Reflectance of image part (%) (980 nm) | Reflectance of non-image part (%) (980 nm) | Absorbance of image part: B (%) (980 nm) | Figure representing reflection property | Absorbance: A (%) (980 nm) | Figure representing reflection property |
| Ex. 1 | 69.4 | 80.3 | 13.6 | FIG. 7, FIG. 8 | 59.5 | FIG. 6 |
| Ex. 2 | 79.1 | 80.3 | 1.5 | FIG. 7, FIG. 9 | 59.5 | FIG. 6 |
| Ex. 3 | 45.0 | 80.3 | 44.0 | FIG. 7, FIG. 10 | 59.5 | FIG. 6 |
| Ex. 4 | 32.1 | 80.3 | 60.0 | FIG. 7, FIG. 11 | 59.5 | FIG. 6 |
| Ex. 5 | 15.6 | 80.3 | 80.6 | FIG. 7, FIG. 12 | 59.5 | FIG. 6 |
| Ex. 6 | 80.0 | 92.5 | 13.5 | FIG. 14, FIG. 15 | 59.5 | FIG. 6 |
| Ex. 7 | 69.4 | 80.3 | 13.6 | FIG. 7, FIG. 8 | 59.5 | FIG. 6 |
| Ex. 8 | 69.4 | 80.3 | 13.6 | FIG. 7, FIG. 8 | 59.5 | FIG. 6 |
| Ex. 9 | 69.4 | 80.3 | 13.6 | FIG. 7, FIG. 8 | 59.5 | FIG. 6 |
| Ex. 10 | 69.4 | 80.3 | 13.6 | FIG. 7, FIG. 8 | 59.5 | FIG. 17 |
| Comp. Ex. 1 | 3.6 | 80.3 | 95.5 | FIG. 7, FIG. 13 | 59.5 | FIG. 6 |
| Comp. Ex. 2 | 3.7 | 92.5 | 96.0 | FIG. 14, FIG. 16 | 59.5 | FIG. 6 |
| Comp. Ex. 3 | 3.6 | 80.3 | 95.5 | FIG. 7, FIG. 13 | 59.5 | FIG. 6 |
| Comp. Ex. 4 | 3.6 | 80.3 | 95.5 | FIG. 7, FIG. 13 | 59.5 | FIG. 6 |
| Comp. Ex. 5 | 3.6 | 80.3 | 95.5 | FIG. 7, FIG. 13 | 59.5 | FIG. 6 |

TABLE 1-continued

| | Conveying container | | | | Recording part | |
|---|---|---|---|---|---|---|
| | Reflectance of image part (%) (980 nm) | Reflectance of non-image part (%) (980 nm) | Absorbance of image part: B (%) (980 nm) | Figure representing reflection property | Absorbance: A (%) (980 nm) | Figure representing reflection property |
| Comp. Ex. 6 | 3.6 | 80.3 | 95.5 | FIG. 7, FIG. 13 | 59.5 | FIG. 17 |

TABLE 2

| | A + 30 > B | A + 10 > B | A > B | Repeating durability | |
|---|---|---|---|---|---|
| Ex. 1 | Yes | Yes | Yes | 10 times | A |
| Ex. 2 | Yes | Yes | Yes | 10 times | A |
| Ex. 3 | Yes | Yes | Yes | 10 times | A |
| Ex. 4 | Yes | Yes | No | 10 times | B |
| Ex. 5 | Yes | No | No | 10 times | B |
| Ex. 6 | Yes | Yes | Yes | 10 times | A |
| Ex. 7 | Yes | Yes | Yes | 10 times | A |
| Ex. 8 | Yes | Yes | Yes | 10 times | A |
| Ex. 9 | Yes | Yes | Yes | 10 times | A |
| Ex. 10 | Yes | Yes | Yes | 10 times | A |
| Comp. Ex. 1 | No | No | No | 3 times | C |
| Comp. Ex. 2 | No | No | No | 3 times | C |
| Comp. Ex. 3 | No | No | No | 3 times | C |
| Comp. Ex. 4 | No | No | No | 5 times | C |
| Comp. Ex. 5 | No | No | No | 3 times | C |
| Comp. Ex. 6 | No | No | No | 3 times | C |

Aspects of the present invention are, for example, as follows:

<1> A conveyor line system including an image processing device configured to irradiate a recording part with laser light to perform at least one of image recording and image erasing, the conveyor line system being configured to manage at least one conveying container including: the recording part in which the image recording is performed by irradiation with the laser light; and an image part in which a displayed image has been drawn, wherein a formula below is satisfied at a wavelength of the laser light with which the recording part is irradiated during the image recording:

$$A+30>B$$

where A denotes an absorbance of the recording part and B denotes an absorbance of the image part of the conveying container.

<2> The conveyor line system according to <1>, wherein a formula: A>B is satisfied.

<3> The conveyor line system according to <1> or <2>, wherein an image recorded during the image recording includes a solid image.

<4> The conveyor line system according to any one of <1> to <3>, wherein the at least one conveying container includes a plurality of conveying containers which are different in at least one of a size and a shape.

<5> The conveyor line system according to any one of <1> to <4>, further including a stopper configured to stop the at least one conveying container at a predetermined position before reaching the image processing device.

<6> The conveyor line system according to any one of <1> to <5>, wherein the image processing device includes: an image recording device configured to irradiate the recording part with the laser light to perform the image recording; and an image erasing device configured to irradiate the recording part with the laser light to perform the image erasing, and wherein the image erasing device is disposed upstream of the image recording device in a conveying direction so as to be adjacent to the image recording device.

<7> The conveyor line system according to any one of <1> to <6>, wherein the recording part is a thermoreversible recording medium.

<8> The conveyor line system according to <7>, wherein the thermoreversible recording medium includes a support and a thermoreversible recording layer on the support, and wherein the thermoreversible recording layer includes a photothermal converting material, a leuco dye, and a reversible color developer, and the photothermal converting material is configured to absorb light of a specific wavelength to convert into heat.

<9> The conveyor line system according to any one of <1> to <8>, wherein the displayed image of the conveying container is drawn with a pigment.

<10> The conveyor line system according to any one of <1> to <9>, wherein the laser light is at least one selected from YAG laser, fiber laser, and semiconductor laser.

<11> The conveyor line system according to any one of <1> to <10>, wherein the wavelength of the laser light is 700 nm or more but 1,600 nm or less.

<12> The conveyor line system according to any one of <1> to <11>, wherein the conveyor line system is used for at least one of a physical distribution management system, a delivery management system, a storage management system, and a process management system in a factory.

<13> A conveying container including:

a recording part in which image recording is performed by irradiation with laser light; and an image part in which a displayed image has been drawn, the conveying container being configured to be used repeatedly, and wherein a formula below is satisfied at a wavelength of the laser light with which the recording part is irradiated during the image recording:

$$A+30>B$$

where A denotes an absorbance of the recording part and B denotes an absorbance of the image part of the conveying container.

<14> The conveying container according to <13>, wherein the recording part is a thermoreversible recording medium.

DESCRIPTION OF THE REFERENCE NUMERAL

001 conveyor line system
002 conveyor line
003 conveying direction of conveyor line
004 conveying container
005 thermoreversible recording medium
006 laser light from image erasing device
007 laser light from image recording device
008 image erasing device
009 image recording device
010 laser light emitted from image recording device
011 laser light emitting outlet of image recording device
012 galvanometer mirror unit
013 reflective mirror
014 condenser lens
015 focal position correcting unit
016 housing of optical head of image recording device
017 collimator lens unit
018 optical fiber
019 control section of image recording device
020 laser light emitted from image erasing device
021 laser light emitting outlet of image erasing device
022 scanning mirror
023 optical lens (for adjusting beam width in width direction)
024 optical lens (for adjusting beam width in length and width directions)
025 optical lens (for adjusting beam width in width direction)
026 optical lens (lens for diffusing laser light in length direction)
027 optical lens (width-direction collimating means)
028 reflective mirror
029 housing of image erasing device
030 semiconductor laser array
031 cooling unit
100 thermoreversible recording medium
101 support
102 thermoreversible recording layer including photothermal converting material
103 first oxygen barrier layer
104 UV ray absorbing layer
105 second oxygen barrier layer

The invention claimed is:

1. A conveyor line system comprising an image processing device configured to irradiate a recording part with laser light to perform at least one of image recording and image erasing, the conveyor line system being configured to manage at least one conveying container including: the recording part in which the image recording is performed by irradiation with the laser light; and an image part in which a displayed image has been drawn, wherein a formula below is satisfied at a wavelength of the laser light with which the recording part is irradiated during the image recording:

$$A+30>B$$

where A denotes an absorbance of the recording part and B denotes an absorbance of the image part of the conveying container, and the absorbance of the image part of the conveying container denoted by B is a value determined according to a formula below:

$$\text{Absorbance of the image part of the conveying container denoted by B (\%)}=100\times(1-C/D)$$

where C (%) denotes a reflectance of the image part of the conveying container in which the displayed image has been drawn, and D (%) denotes a reflectance of a non-image part of the conveying container in which the displayed image is not drawn, with the proviso that when C>B, the absorbance of the image part of the conveying container denoted by B is determined as 0 (%).

2. A conveyor line system comprising an image processing device configured to irradiate a recording part with laser light to perform at least one of image recording and image erasing, the conveyor line system being configured to manage at least one conveying container including: the recording part in which the image recording is performed by irradiation with the laser light; and an image part in which a displayed image has been drawn, wherein a formula A>B is satisfied, and wherein a formula below is satisfied at a wavelength of the laser light with which the recording part is irradiated during the image recording:

$$A+30>B, \text{ and}$$

where A denotes an absorbance of the recording part and B denotes an absorbance of the image part of the conveying container, and the absorbance of the image part of the conveying container denoted by B is a value determined according to a formula below:

$$\text{Absorbance of the image part of the conveying container denoted by B (\%)}=100\times(1-C/D)$$

where C (%) denotes a reflectance of the image part of the conveying container in which the displayed image has been drawn, and D (%) denotes a reflectance of a non-image part of the conveying container in which the displayed image is not drawn, with the proviso that when C>B, the absorbance of the image part of the conveying container denoted by B is determined as 0 (%).

3. The conveyor line system according to claim 1, wherein an image recorded during the image recording includes a solid image.

4. The conveyor line system according to claim 1, wherein the at least one conveying container includes a plurality of conveying containers which are different in at least one of a size and a shape.

5. The conveyor line system according to claim 1, further comprising a stopper configured to stop the at least one conveying container at a predetermined position before reaching the image processing device.

6. The conveyor line system according to claim 1, wherein the image processing device includes: an image recording device configured to irradiate the recording part with the laser light to perform the image recording; and an image erasing device configured to irradiate the recording part with the laser light to perform the image erasing, and wherein the image erasing device is disposed upstream of the image recording device in a conveying direction so as to be adjacent to the image recording device.

7. The conveyor line system according to claim 1, wherein the recording part is a thermoreversible recording medium.

8. The conveyor line system according to claim 7, wherein the thermoreversible recording medium includes a support and a thermoreversible recording layer on the support, and wherein the thermoreversible recording layer includes a photothermal converting material, a leuco dye, and a reversible color developer, and the photothermal converting material is configured to absorb light of a specific wavelength to convert the light into heat.

9. The conveyor line system according to claim 1, wherein the displayed image of the conveying container is drawn with a pigment.

10. The conveyor line system according to claim 1, wherein the laser light is at least one selected from YAG laser, fiber laser, and semiconductor laser.

11. The conveyor line system according to claim 1, wherein the wavelength of the laser light is 700 nm or more but 1,600 nm or less.

12. The conveyor line system according to claim 1, wherein the conveyor line system is used for at least one of a physical distribution management system, a delivery management system, a storage management system, and a process management system in a factory.

13. A conveying container comprising:

a recording part in which image recording is performed by irradiation with laser light; and an image part in which a displayed image has been drawn, the conveying container being configured to be used repeatedly, and wherein a formula below is satisfied at a wavelength of the laser light with which the recording part is irradiated during the image recording:

$$A+30>B$$

where A denotes an absorbance of the recording part and B denotes an absorbance of the image part of the conveying container, and the absorbance of the image part of the conveying container denoted by B is a value determined according to a formula below:

$$\text{Absorbance of the image part of the conveying container denoted by } B(\%)=100\times(1-C/D)$$

where C (%) denotes a reflectance of the image part of the conveying container in which the displayed image has been drawn, and D (%) denotes a reflectance of a non-image part of the conveying container in which the displayed image is not drawn, with the proviso that when C>B, the absorbance of the image part of the conveying container denoted by B is determined as 0 (%).

14. The conveying container according to claim 13, wherein the recording part is a thermoreversible recording medium.

* * * * *